US008365954B2

(12) United States Patent
Ophardt et al.

(10) Patent No.: US 8,365,954 B2
(45) Date of Patent: Feb. 5, 2013

(54) COLLAPSIBLE BOTTLE AND COVER

(75) Inventors: Heiner Ophardt, Vineland (CA); Ali Mirbach, Issum (DE)

(73) Assignee: Gotohti.com, Inc., Ontario (CA)

( * ) Notice: Subject to any disclaimer, the term of this patent is extended or adjusted under 35 U.S.C. 154(b) by 1026 days.

(21) Appl. No.: 12/289,367

(22) Filed: Oct. 27, 2008

(65) Prior Publication Data

US 2009/0114679 A1 May 7, 2009

(30) Foreign Application Priority Data

Nov. 7, 2007 (CA) ..... 2609637
Jun. 27, 2008 (CA) ..... 2636525

(51) Int. Cl.
*B65D 35/28* (2006.01)

(52) U.S. Cl. ..... 222/95; 222/105; 220/666

(58) Field of Classification Search ..... 222/92, 222/95, 96, 105–107, 209, 214, 215; 220/666, 220/667, 671, 674, 907, 11.3; 215/900, 383
See application file for complete search history.

(56) References Cited

U.S. PATENT DOCUMENTS 684,986 A * 10/1901 Higgins ..... 222/92
3,288,334 A * 11/1966 Corsette ..... 222/107
3,595,441 A * 7/1971 Grosjean ..... 222/107
3,727,803 A 4/1973 Cobb
3,810,503 A 5/1974 Lewis, Jr. et al.
5,165,577 A 11/1992 Ophardt
5,255,808 A 10/1993 Tobler
D350,070 S 8/1994 Ophardt
5,373,965 A * 12/1994 Halm et al. ..... 222/92
5,489,044 A 2/1996 Ophardt
5,556,005 A 9/1996 Banks
5,935,659 A 8/1999 Cane et al.
5,975,360 A 11/1999 Ophardt
6,158,620 A 12/2000 Polan
6,220,702 B1 * 4/2001 Nakamura et al. ..... 347/86
7,232,045 B2 6/2007 Ophardt
7,357,267 B1 4/2008 Shimada et al.
2006/0032865 A1 2/2006 Ophardt
2010/0084428 A1 * 4/2010 Bakhos ..... 222/107

FOREIGN PATENT DOCUMENTS

CA 2664246 * 4/2008
GB 2427120 12/2006

* cited by examiner

*Primary Examiner* — Kevin P Shaver
*Assistant Examiner* — Robert Nichols, II
(74) *Attorney, Agent, or Firm* — Thorpe North & Western LLP

(57) ABSTRACT

In combination with a collapsible container with a dimension that varies as the container collapses from a full position to an empty position, the bottle cover with a sight opening for viewing of indicia on the bottle to provide an indication as to the extent the bottle is full or empty.

9 Claims, 26 Drawing Sheets

COLLAPSIBLE BOTTLE AND COVER

SCOPE OF THE INVENTION

This invention relates to collapsible containers for fluids and, more particularly, to a collapsible bottle which, on collapsing, provides in combination with a cover an indication as to the extent to which the bottle is full or collapsed.

BACKGROUND OF THE INVENTION

The inventors of this application have appreciated a disadvantage of previously known dispensers for soap and other fluids that they do not provide a simple and convenient manner for indicating whether or not a container for the soap or other fluid to be dispensed is full or empty. The ability of a dispenser for soap or other fluids to provide an indication as to whether or not a container containing the soap or fluid is full is of considerable assistance in monitoring such dispensers and determining whether or not to replace or refill containers for the soap and other fluids.

Collapsible dispensers for soap and other fluids are known which are self supporting as when filled with material yet are provided to collapse upon themselves.

The inventors of this application have also appreciated a disadvantage of previous known collapsible containers that when they collapse, the collapsed container does not provide a self-supporting structure which can be relied upon to locate the container relative to other elements. More particularly, previously known collapsible containers have been appreciated to not be capable of continuing to support themselves in a vertical orientation supported on a base of the container both in an uncollapsible condition and in a collapsed condition. Further, the present inventors have appreciated that previously known collapsible dispensers suffer the disadvantage that back, side or front surfaces of the container also do not adopt consistent configurations when collapsed which can serve to assist in locating the collapsed dispenser relative, for example, to other portions of the bottle or to other surfaces such as the housing or support for a dispenser.

SUMMARY OF THE INVENTION

To at least partially overcome some of these disadvantages of previously known devices, the present invention provides in combination with a collapsible container with a dimension that varies as the container collapses from a full position to an empty position, the bottle cover with a sight opening for viewing of indicia on the bottle to provide an indication as to the extent the bottle is full or empty.

To at least partially overcome some of these disadvantages of previously known devices, the present invention provides a collapsible container closed but for an opening from an outlet end and having at the other base end, a three dimensional structure formed by a bottom wall, a central portion and peripheral edge portions which are sufficiently strong to resist deflection and maintain support portions of the base end in desired positions, preferably disposed in a flat plane both while a container is full and while in a collapsed or uncollapsed condition of the container. Preferably, the base has the support portions disposed in a flat plane normal to a longitudinal of the container and will support the container on a horizontal support surface with a longitudinal of the container to extend vertically upwardly therefrom, preferably, in all collapsed and uncollapsed conditions of the container.

An object of the invention is to provide a combination of a collapsible bottle, a pump assembly and a bottle cover which cooperate to provide a visual indication as to the extent to which the collapsible container is full or empty.

Another object of the present invention is to provide a supporting housing to support the collapsible container about an outlet of the container.

Another object of the present invention is to provide a collapsible container which has an inherent structure which, whether collapsed or uncollapsed, assists in supporting the container against the environment in which the container may be disposed.

In accordance with one aspect of the present invention, there is provided a thin walled collapsible container preferably formed from plastic material such as polyethylene as by blow moulding. The container has an outlet end, a closed based end and a side wall connecting the outlet end to the closed based end. The container is closed but for an opening from the outlet end. The side wall extends longitudinally of the container from the outlet end to the base end about a longitudinal of the container. The container is of a type which on collapsing of the container under vacuum applied to withdraw fluid from the outlet end, portions of the side wall are drawn together and the length dimension of the container between the base end and the outlet end is varied with a relative longitudinal position compared to the outlet end of the base end and portions of the side walls being indicative of the extent to which the bottle is uncollapsed or collapsed. A pump mechanism is coupled to the container and activable to draw fluid out of the bottle via the outlet opening and creating a vacuum in the bottle. A bottle cover is connected to the outlet end of the bottle. The cover has a sighting wall panel fixed to extend longitudinally from the outlet end of the bottle towards the base end longitudinally along the side wall of the container outwardly of the side wall of the container. A sight opening is provided through the sighting wall panel through which a person may view portions of the container behind the sight opening. Visual indicia are provided on the base end and are on portions of the side wall which are moved relative the outlet end on collapsing of the container. The visual indicia are visible through the sight openings and the relative longitudinal position of the visual indicia compared to the sight openings are indicative of the extent to which the bottle is uncollapsed or collapsed.

In the preferred embodiments, the combination provides a mechanism for a person to visually see the extent to which a bottle is uncollapsed or collapsed.

The cover may comprise a complete shroud or housing to enclose the bottle or may comprise but a mere panel to overlie the side wall of the bottle insofar as the bottle is hung vertically in front of a vertical support surface, then the cover may be arranged to have a rear portion removably coupled to the support surface.

The cover may in an embodiment comprise a sleeve to support an outlet end of the collapsible container at a height above a horizontal support surface.

In one aspect, the present invention provides in combination a collapsible container, a pump mechanism, and a cover for the container;

the container comprising an outlet end, a closed base end, and a side wall connecting the outlet end and the closed base end, the container closed but for an opening from the outlet end, the outlet end having a top wall, the top wall including a central portion about an axially extending neck open to the opening and peripheral edge portions about the central portion merging with the side wall, the side wall extending longitudinally of the container from the outlet end to the base end about a longitudinal of the container, the base end having a bottom wall including a central portion and peripheral edge portions about the central portion merging the central portion into the side walls, the container being of a type which on collapsing of the container under a vacuum applied to withdraw fluid from the outlet end, portions of the side wall are drawn together to fold about the side wall upon itself and draw the base end longitudinally toward the outlet end with the relative longitudinal position compared to the outlet end of the base end and portions of the side wall being indicative of the extent to which the bottle is uncollapsed or collapsed, the pump mechanism coupled to the container and activatable to draw fluid out of the bottle via the outlet opening and creating a vacuum in the container, the cover connected to the outlet end of the container, the cover having a sighting wall panel fixed to extend longitudinally from the outlet end toward the base end longitudinally along the side wall of the container outwardly of the side wall of the container, a sight opening through the sighting wall portion through which a person may view portions of the container behind the sight opening, visual indicia provided on the base end and/or portions of the side wall which are drawn toward the outlet end on collapsing of the container, the visual indicia being visible through the sight opening and the relative longitudinal position of the visual indicia compared to the sight opening being indicative of the extent to which the bottle is uncollapsed or collapsed.

In accordance with another aspect of the present invention, there is provided a thin walled collapsible container preferably formed from plastic material such as polyethylene as by blow moulding. The container is preferably rectangular and has an outlet end, a closed base end, front wall, rear wall and two side walls. The container is closed but for an opening from the outlet end. The outlet end has a top wall with a generally rectangular perimeter as seen in end view. The end wall includes an annular central portion about an axially extending neck open to the opening and peripheral edge portions about the central portion merging with the front, rear and two side walls. The front, rear and two side walls extend longitudinally of the container from the outlet end to the base end about a longitudinal of the container. The container is symmetrical about a flat central plane including the longitudinal which is intermediate the side walls. The base end has a bottom wall with a generally rectangular perimeter as seen in end view. The bottom wall includes a central portion and peripheral edge portions about the central portion merging the central portion into the front, rear and two side walls. The base end preferably has support portions of the peripheral rounded edge portions of the base end disposed in a flat plane normal to the longitudinal of the container and serving to support the container on a horizontal support surface with the longitudinal of the container to extend upwardly. Each of the front wall and the rear wall carry a respective front and rear valley having left and right valley side walls extending centrally into each front wall and rear wall towards a respective other of the rear and front wall to a respective front and rear valley apex. Each valley apex extends longitudinally of the container in a central plane from an outlet end of the respective front and rear valley apex to a base end of the respective front and rear valley apex. Each of the front and rear valleys end longitudinally at respective front and rear valley end walls which bridge between the right and left valley side walls of the respective front and rear valley. Each end valley wall is located between its respective valley and either the outlet end or the base end. Each end valley wall preferably presents a generally frusto-conical surface symmetrical about the central plane and curving 180° about its respective valley apex.

The base end has a three dimensional structure formed by its bottom wall central portion and peripheral edge portions which is sufficiently strong to resist deflection and preferably maintain its support portions in a flat plane on collapsing of the container. One preferred embodiment, the central annular portion of the bottom wall, is inwardly convex and the peripheral edge portions about the central portion are inwardly concave rounded edge portions.

On collapsing of the container in a vacuum applied to withdraw fluid from the outlet end, the side walls are drawn together towards the common plane with the front and rear walls folding about the front valley apex and the rear valley apex.

Each of the front wall and rear wall preferably have a planar portion surrounding their respective valley. Each left and right valley wall is preferably disposed in a flat plane with a perimeter of each left and right valley side wall merging along a straight line with such planar portion extending parallel to the longitudinal. A perimeter of each of the valley end walls preferably merges along a curved line with such planar portion and joins an end of the straight line of the right valley perimeter with an end of the straight line at the left valley perimeter.

Preferably, the outlet end also has a three dimensional structure formed by its top wall, central portion, neck and peripheral edge portions sufficiently strong to resist deflection and maintain its peripheral edge portion in the same positions relative the neck on collapsing the container.

Preferably, the front and rear valley apexes are spaced from each other providing a channelway therebetween along their length from the base towards the outlet end in all collapsed and uncollapsed conditions of the container, preferably, at least adjacent each valley apex.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
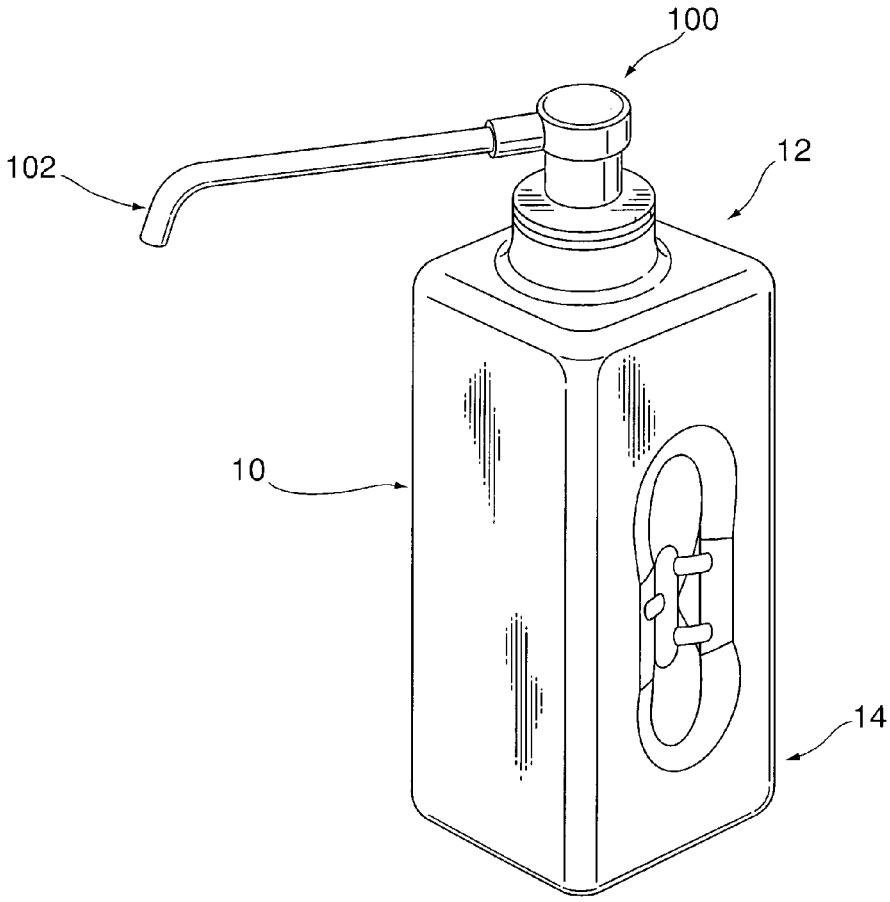
FIG. 1 is a pictorial view of a collapsible bottle in combination with a pump mechanism in accordance with a first embodiment of the present invention.

Reference is made to FIG. 1 which shows a bottle 10 in accordance with the present invention having a piston pump assembly 100 sealably secured to its outlet end 12.

The pump mechanism 100 is a piston pump mechanism which when manually actuated by urging the pump downwardly dispenses an allotment of soap out of a nozzle 102 of the pump. The pump piston when returned to its extended position is ready to pump additional allotments of fluid from the bottle 10. The pump mechanism 100 sealably engages the outlet end 12 of the bottle such that on dispensing fluid by use of the pump mechanism 100, the bottle 10 becomes collapsed and moves to a collapsed condition as is illustrated in FIGS. 7 to 11.

In a preferred manner of use of the bottle as illustrated in FIG. 1, the outlet end 12 is considered to be an upper end of the bottle and a base end 14 as a lower end of the bottle. This is not necessary and the bottle can be used in any position such as inverted or on its side or the like since dispensing by use of the pump draws fluid out of the bottle with collapse of the bottle.

Preferably, with the bottle entirely filled with fluid to be dispensed and containing no gas, pumping the fluid from the bottle will occur irrespective of the up or down orientation of the bottle. Nevertheless, in this disclosure, when referred to as up or as down, this is intended to refer to a configuration with the outlet end 12 being an upper end and the base end 14 a lower end.

Figure 4:
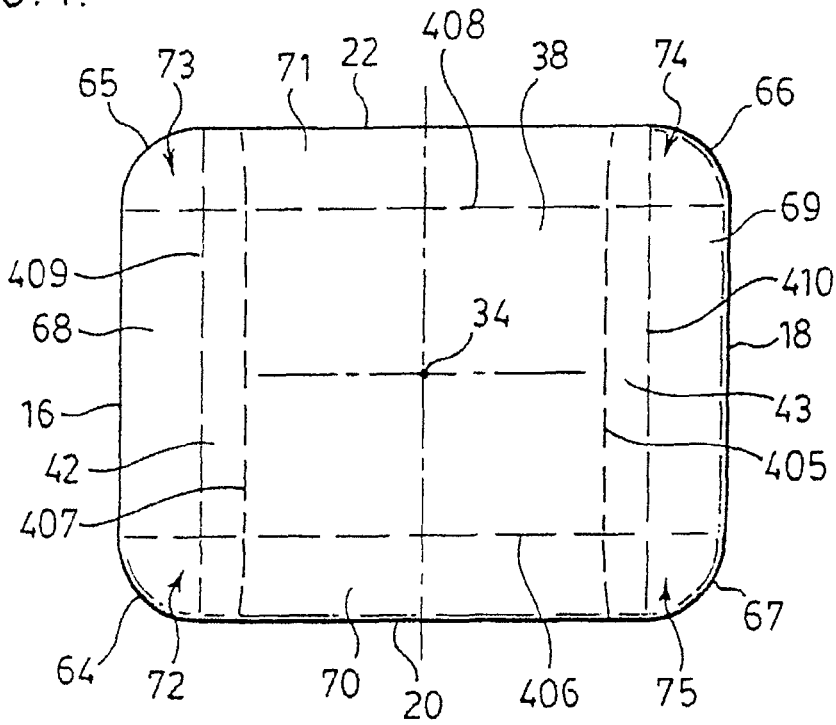
FIG. 4 is a bottom view of the bottle shown in FIG. 2.

The bottle has a generally rectangular cross-section and, as best seen in FIG. 4, includes a front wall 16, a rear wall 18 and two side walls 20 and 22. The bottle 10 is closed but for an opening 24 from the outlet end 12. The outlet end has a top wall 26 with a generally rectangular perimeter if seen in an end view similar to that shown in FIG. 4. The top wall 26 includes an annular central portion 28 about an axially extending neck 30. The neck 30 is open to the opening 24. The top wall 26 includes peripheral edge portions 32 about the central portion 28 which central edge portions 32 merge with the front wall 16, rear wall 18 and two side walls 20 and 22.

In the preferred embodiment, the neck 30 has an axis extending coaxially therethrough which axis is coincident with a longitudinal 34 through the bottle 10. The bottle 10 is symmetrical about a flat central plane 35 intermediate the side walls 20 and 22 which flat central plane includes the longitudinal 34.

The base end 14 has a bottom wall 36 with a generally rectangular perimeter as seen in end view in FIG. 4. The bottom wall 36 includes a central portion 38 and peripheral side portions about the central portion 38. Peripheral edge portions merge the central portion 38 into the front wall 16, rear wall 18 and two side walls 20 and 22. The base end 14 preferably has support portions 42 and 43 disposed in a flat plane normal to the longitudinal 34 of the bottle 10 and serving to support the container on a horizontal support surface 44, schematically illustrated in FIG. 6, with the bottle in a position with the longitudinal 34 of the bottle to extend vertically upwardly normal to the horizontal support surface 44. The support portions in the preferred embodiment comprise the two portions 42 and 43 of the bottom wall 36.

The front wall 16 carries a front valley 50 defined by left valley wall 51 and right valley wall 52 which extend centrally into the front wall 16 to a front valley apex 53 extending longitudinally of the bottle 10 in the central plane 35 from an outlet end 54 of the front valley apex to a base end 55 of the front valley apex. The front valley 50 ends longitudinally proximate the outlet end as an outlet end valley end wall 56 which bridges between the left valley side wall 51 and the right valley side wall 52 of the front valley 50. The front valley 50 ends longitudinally proximate the base end as a base end valley end wall 57 which bridges between the left valley side wall 51 and the right valley side wall 52 of the front valley 50.

Figure 2:
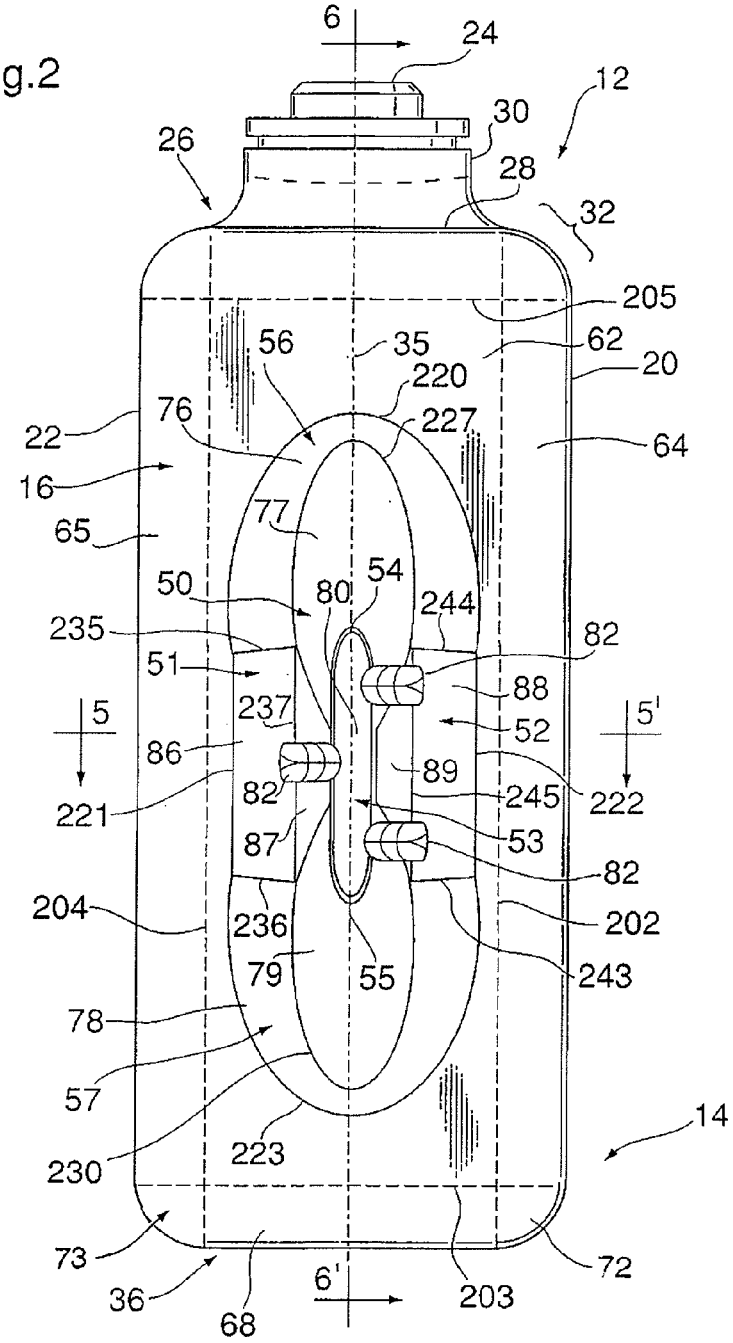
FIG. 2 is a front view of the bottle shown in FIG. 1.

In each of FIGS. 2 to 6, dashed lines are shown which indicate the location of a change of plane in the surface of the bottle 10. For example, referring to FIG. 3, on the side wall 20, a rectangular central portion 60 is defined between lines 302, 303, 304 and 305 with the central portion 60 preferably being a flat planar surface disposed in a plane parallel to the longitudinal 34 and the central plane 35. Referring to FIG. 2, a central portion 62 is shown on the front wall 16 defined within dashed lines 202, 203, 204 and 205. The central portion 62 is a flat planar surface normal to central plane 35.

Figure 3:
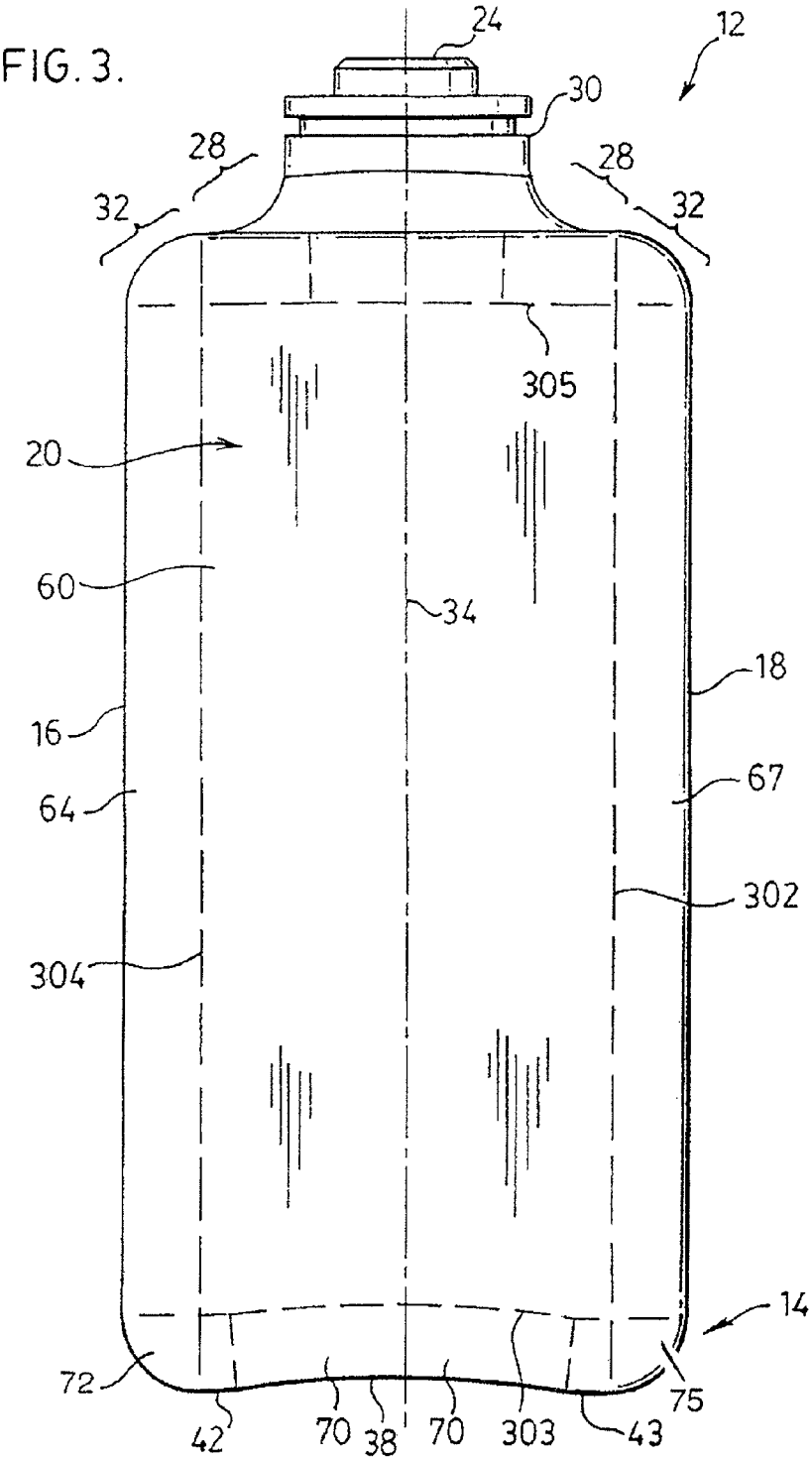
FIG. 3 is a side view of the bottle shown in FIG. 2.

Referring to FIG. 4, corner portions 64, 65, 66 and 67 are shown. Each corner portion extends vertically, for example, regarding corner portion 64, the corner portion 64 is outwardly of the dashed line 202 in FIG. 2 and outwardly of the dashed line 302 in FIG. 3, with the corner portion 64 rounded between the dashed line 202 and the dashed line 304. As seen in FIG. 4, corner portion 64 is disposed between dashed lines 406 and 407. In FIGS. 2 and 3, corner portion 64 is shown extending vertically between dashed lines 203 and 205 and between dashed lines 303 and 305, respectively. The corner portions 65, 66 and 67 are thus similar and disposed between similarly disposed dashed lines.

Referring further to FIG. 4, the central portion 38 of the bottom wall 36 is defined between dashed lines 405, 406, 407 and 408. As seen in FIG. 3, the central portion 38 is inwardly concave. Bridging between the central portion 38 and the central portion 62 on the front wall 16 is a front peripheral rounded edge portion 68 defined between dashed lines 409, 203, 406 and 408. A similar rounded rear edge portion 69 mirrors the front edge portion 68. Referring to FIG. 4, a side edge portion 70 is defined between a dashed line 406 and line 303 between lines 405 and 407. A similar side edge portion 71 is defined on the other side outward of dashed line 408. FIG. 4 shows on the base end the support surface 42 as a panel disposed between lines 406, 409 408 and 407 and the support surface 43 as a similar panel between lines 406, 405, 408 and 410. As best seen in FIG. 3, these support portions 42 and 43 serve to join the front and rear edge portions 68 and 69 with the concave central portion 38. Corner edge portions 72 and 73 near the front and corner edge portions 74 and 75 near the rear end serve to bridge between one of the side edge portions 70 and 71 and one of the rounded end edge portions 68 and 69. Each corner edge portion 70, 71, 72 and 73 is vertically in line with a respective of the corner portions 64, 65, 66 and 67 as seen in FIG. 4.

Referring to FIG. 2, the front valley 50 has an outer perimeter generally indicated by lines 220, 221, 222 and 223 forming the boundary between the flat central portion 62 and the front valley 50. The left valley side wall 51 merges with the central portion 62 as the straight line 221. The right valley side wall 52 merges with the central portion 62 at the straight line 222. The outlet end valley end wall 56 merges with the flat central portion 62 as the curved line 220 with the ends of line 223 joining an outlet end of line 221 and an outlet end of line 222. The front valley 50 has a base end valley end wall 57 which bridges between the right valley side wall 52 and the left valley side wall 51. The base end valley end wall 57 merges with the central portion 62 at the curved line 223 which extends from a base end of the line 221 to a base end of the line 222. The line 220 effectively extends 180° about the outlet end 54 of the valley apex 53. The line 223 effectively extends and curves about 180° about the base end 55 of the end valley apex 53.

The outlet end valley end wall 56 is formed from two different portions including an outer portion 76 and an inner portion 77 with the outer portion 76 defined between the line 220 and intermediate line 227 and the inner portion 77 defined interior of line 227. Similarly, the base end valley end wall 57 is defined as an outer portion 78 and interior portion 79 with the outer portion 78 defined between line 223 and an intermediate line 230 and the interior portion 79 defined inside line 230. Each of the valley end walls 56 and 57 are symmetrical about the central plane 35.

Figure 6:
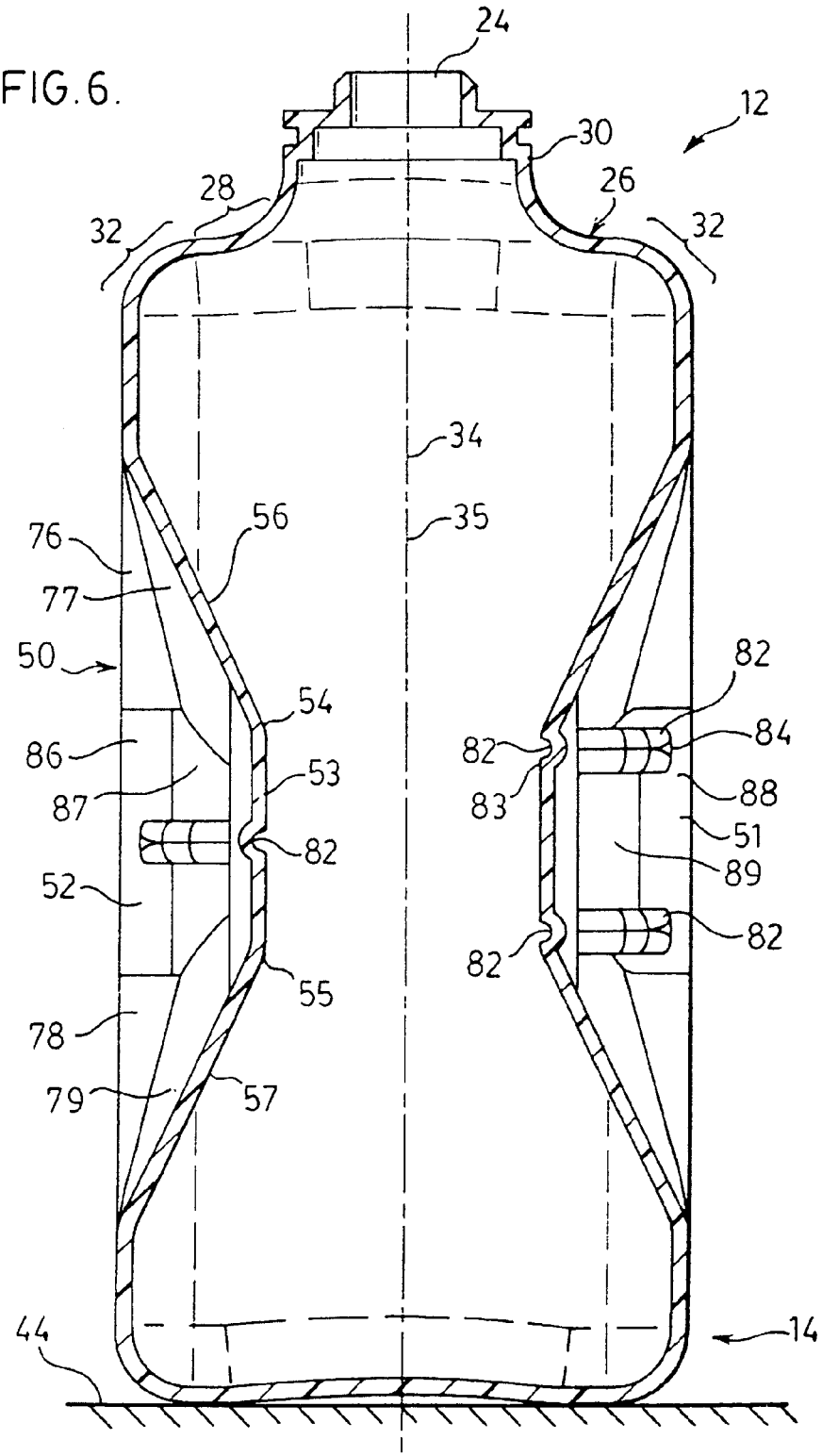
FIG. 6 is a cross-sectional side view along section line 6-6' in FIG. 2.

Each end valley wall 56 and 57 effectively present a generally frusto-conical surface symmetrical about the central plane 35 and curving 180° about its respective apex end 54 or 55. This is best seen in FIG. 6, in any plane normal to the central plane 35 and passing through the apex end 54 or 55, the valley end wall 56 or 57 will be at a greater depth from the central portion 62 with distance from the central portion 62.

It is to be seen that the lines 220 and 223 define, in effect, an ovaloid shape as seen in FIG. 2 and the lines 227 and 230 similarly define a relatively ovaloid shape. In this description, the contours of the outer portion 76 and the interior portion 77 of the outlet end valley end wall 56 are referred to as being frusto-conical in the sense of curving about 180° about the apex end 54 and angling away from the end 54 and outwardly towards the central portion 62. Each forms a somewhat conical surface in the sense of tapering upwardly and outwardly albeit the conical surfaces in the embodiment illustrated in FIG. 2 are not coaxially about the apex end 54.

Figure 5:
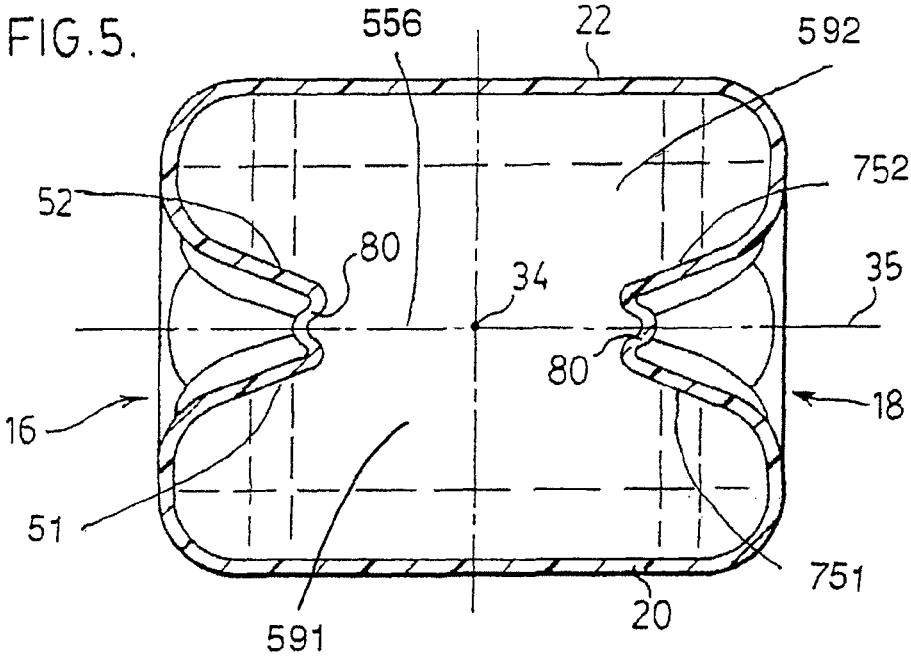
FIG. 5 is a cross-sectional view along section line 5-5' in FIG. 2.

Longitudinally about the front valley apex 53, an apex channel member 80 is provided having, as seen in side view in FIG. 2, to have an elongate oval configuration and having as seen in cross-sectional view in FIG. 5, a generally U-shape which is inwardly concave and outwardly convex. As seen in FIG. 2, three side channel members 82 extend from the apex channel member 80 normal to the longitudinal 34. As best seen in side view in FIG. 6, each side channel member 82 is U-shaped and inwardly concave and outwardly convex. Each of the side channel members 82 have an inner end 83 in the apex channel member 80 and an outer end 84 which terminates within the left valley side wall 51 or right valley side wall 52. As shown in FIG. 2, three side wall members 82 are provided, one in the middle of the apex channel member 80 on the left valley side wall 51 and two side channel members 82 on the right valley side wall 52 equally spaced about the side channel member 82 on the left valley side wall 51. While merely three side channel members 82 are shown in each valley in the preferred embodiment, an increased number of the side channel members 82 may be provided. While in FIG. 2 the side channel members 82 are shown as being offset from each other on the left and right valley side walls, this is not necessary and they could be provided at the same longitudinal locations along the side walls.

The left valley side wall 51 comprises a generally rectangular outer portion 86 defined between lines 221, 235, 236 and 237. The left valley side wall 51 also includes a generally triangular inner portion 87 defined between the lines 237, 227 and 230. The side channel member 82 is formed so as to extend from the apex channel member 80 as a U-shaped inwardly directed channel on the left valley side wall 51.

Similarly, the right valley side wall 52 has a generally rectangular outer portion 88 defined within the lines 222, 243, 244 and 245 and a generally triangular inner portion 89 defined between the lines 245, 227 and 230.

Each of the apex channel member 80 and the side channel members 82 provide stiffening reinforcements to the front valley 50 and, as well, serve in a collapsed bottle as non-collapsible portions which assist in maintaining communication longitudinally and laterally within the interior of the bottle when collapsed.

The description has been made principally with reference to the front wall 16 and its front valley 50 and the side wall 20. With the bottle symmetrical about the central plane 35, it is to be appreciated that the rear wall 18 and its rear valley 50 and the side wall 22 will have the same identical configuration to that described albeit as a mirror image in respect of the side channel member 82.

Figure 7:
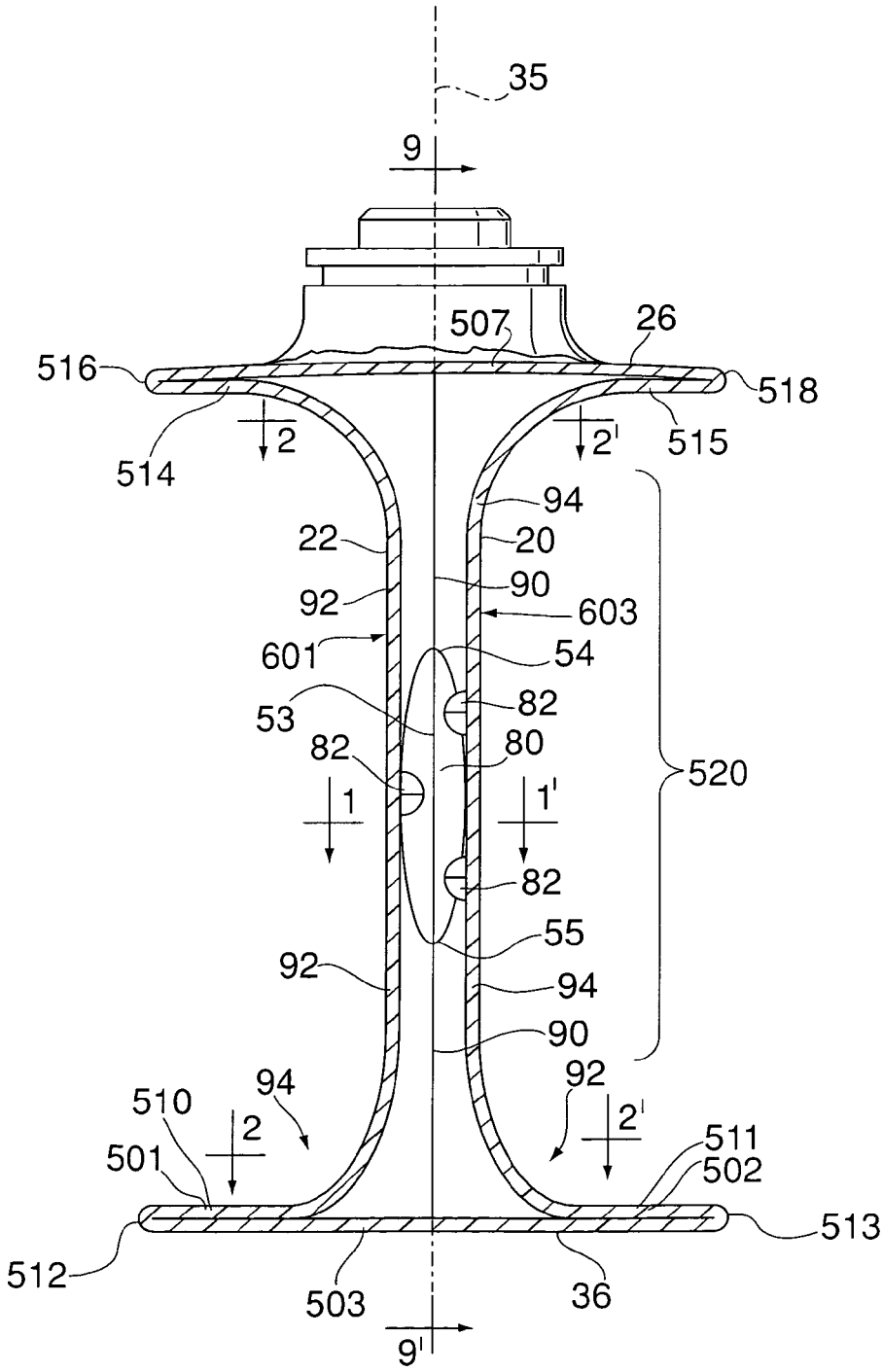
FIG. 7 is a front view similar to FIG. 2 but showing the bottle of FIG. 1 without the pump assembly and in a substantially fully collapsed condition.

Reference is made to FIGS. 7 to 11 which illustrate the bottle 10 in a substantially fully collapsed condition. FIG. 7 shows a side view of the collapsed bottle 10.

In collapse of the bottle, the side walls 20 and 22 are drawn together. The front wall 16 folds within its front valley 50 along the front valley apex 53 such that the left valley side wall 51 and right valley side wall 52 come to extend generally parallel to the central plane 35 in opposition to each other spaced by the channel member 80. In effect, the opposing portions 86 and 88 of the valley side walls come to be disposed substantially parallel to the central plane in opposition to each other as folded about the apex 53. As seen, for example, in the cross-section of FIGS. 10 and 11, the front wall 16 becomes folded upon itself, about a central fold 90 and two edge folds 92 and 94. Similarly, the rear wall 18 becomes folded upon itself about a central fold 91 and two edge folds 93 and 95.

Figure 8:
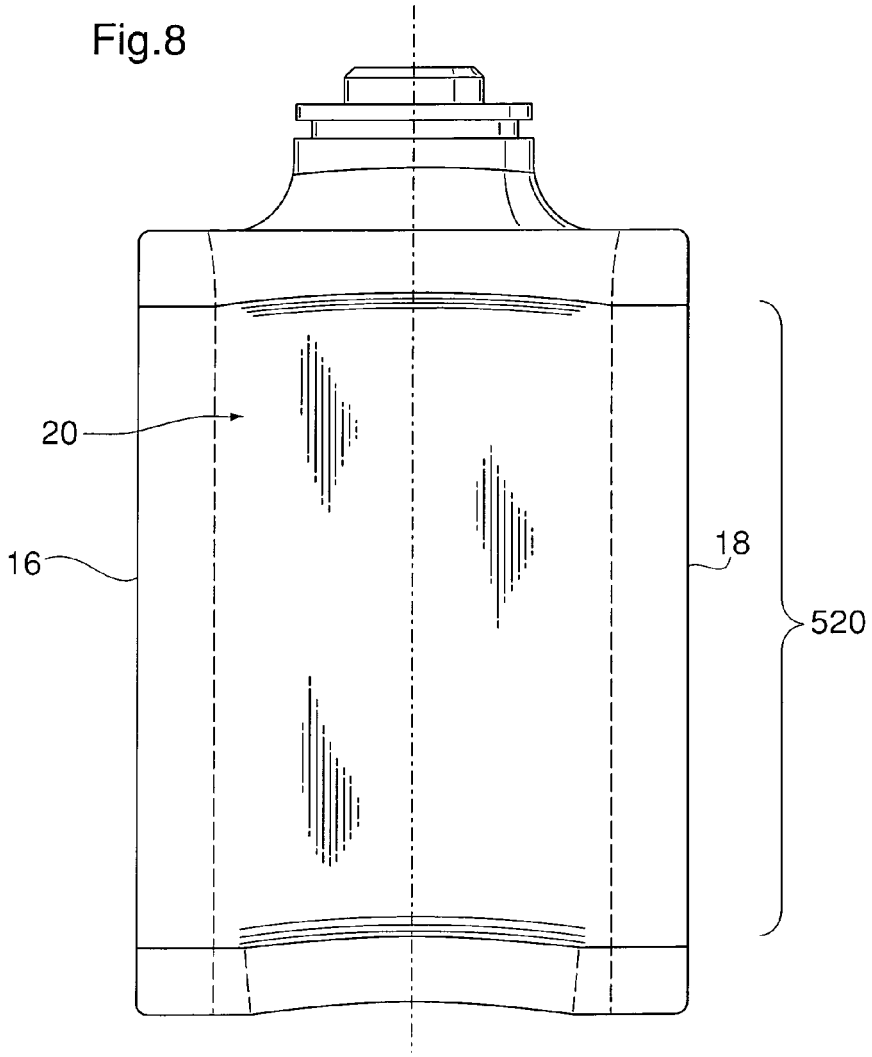
FIG. 8 is a side view of the collapsed container of FIG. 7.
Figure 9:
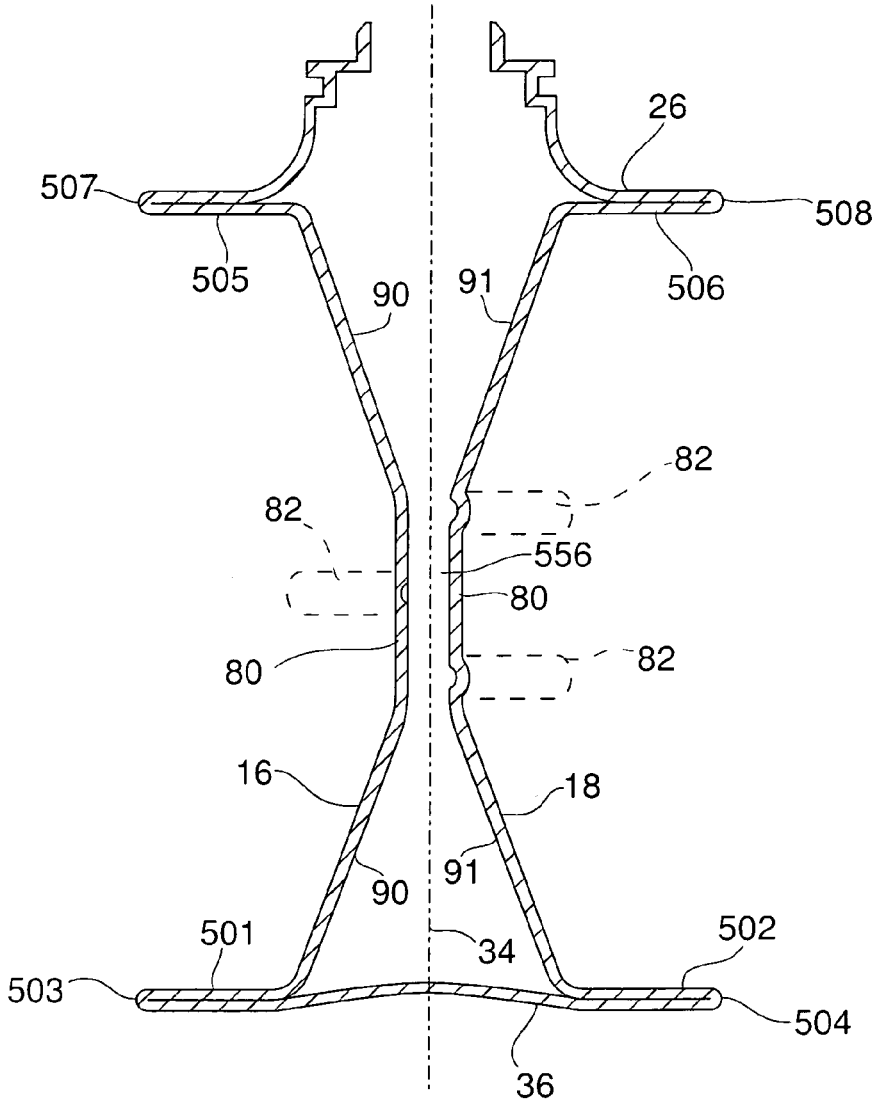
FIG. 9 is a cross-sectional side view along section line 9-9' in FIG. 7.

In collapse of the bottle, the overall longitudinal dimension of the bottle becomes reduced as can be seen by a comparison of the uncollapsed bottle in FIGS. 2, 3 and 6 with the collapsed bottle in corresponding FIGS. 7, 8 and 9. In collapse of the bottle, the front wall 16 and rear wall 18 are drawn together while folded about their center as about the central folds 90 and 91. A base end front wall portion 501 and a base end rear wall portion 502 become folded at folds 503 and 504 to overlie the bottom wall 36 reducing the bottle length. Similarly, outlet end front wall portion 505 and outlet end rear wall portion 506 become folded at folds 507 and 508 to underlie the top wall 26 reducing the bottle length.

As seen in FIG. 7, a base end front wall portion 510 and a base end rear wall portion 511 become folded at folds 512 and 513 to overlie the bottom wall 36 reducing the length of the bottle. Similarly, an outlet end front wall portion 514 and an outlet end rear wall portion 515 become folded at folds 516 and 518 to underlie the top wall 26 reducing the bottle length. As seen in FIG. 7, the folds 512 and 513 overlie the front fold 503, and the folds 516 and 518 overlie the fold front 507 by reason that the front wall 16 becomes drawn first in a gusted type manner. Similarly, while not shown, the folds 512 and 513 will overlie the rear fold 504 and the folds 516 and 518 will overlie the rear fold 508.

Figure 10:
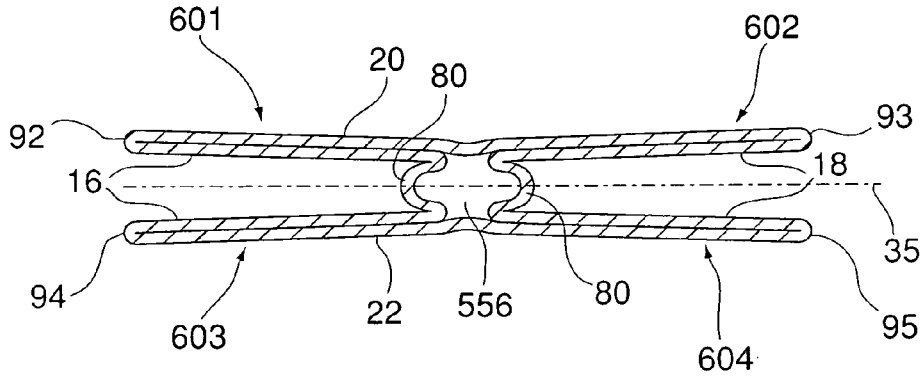
FIG. 10 is a cross-sectional side view along section line 1-1' in FIG. 7.
Figure 11:
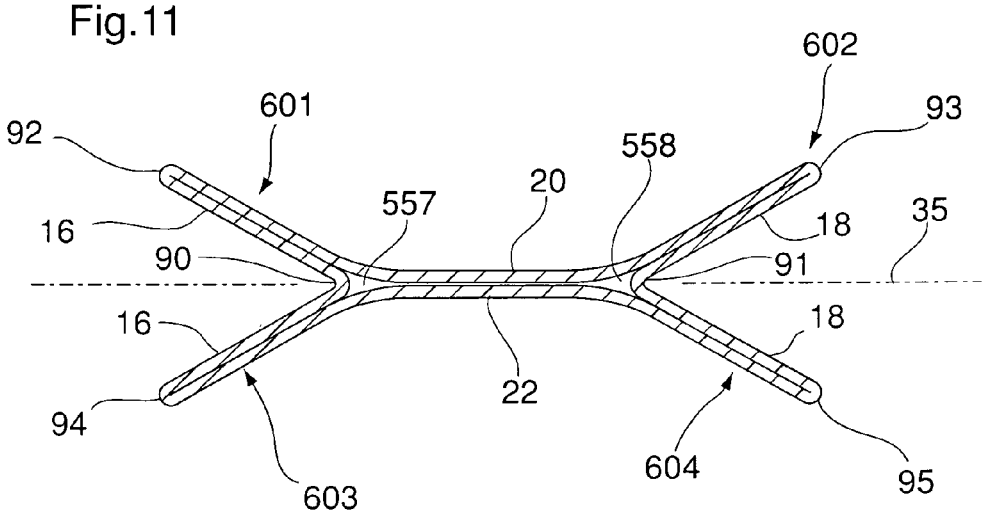
FIG. 11 is a cross-sectional side view along either of the two section lines 2-2' in FIG. 7.

Referring to FIGS. 7, 10 and 11, the central fold 90 of the front wall extends from each end of the channel member 80, that is, from the base end 55 of the front valley apex 55 to the base end and from the outlet end 54 of the front valley apex 55 to the outlet end.

In collapse of the bottle, the opposed front and rear channel members come to be moved inwardly towards each other. This can be seen firstly by a comparison of the cross-sectional views of FIG. 5 when uncollapsed and FIG. 10 when collapsed, with the channel members 80 spaced a significantly greater distance in FIG. 5 than in FIG. 10. This can also be seen secondly by a comparison of the cross-sectional views of FIG. 6 when uncollapsed and FIG. 9 when collapsed with the channel members spaced a significantly greater distance in FIG. 6 than in FIG. 9.

Referring to FIG. 10, it can be seen that the side wall 20 has become collapsed about fold lines 92 and 93 at each end onto a respective half of the front wall 16 and the rear wall 18, forming a collapsed front arm 601 and a collapsed rear arm 602. Similarly, the side wall 22 has become collapsed about fold lines 94 and 95 at each end onto a respective half of the front wall 16 and the rear wall 18, forming a collapsed front arm 603 and a collapsed rear arm 604. The arms 601, 602, 603 and 604 extend generally parallel the central plane 35 spaced the width of the channel members 80 and form together with the channel members an I-shaped beam member providing strength and resisting deflection.

As seen in FIG. 7, over a longitudinal portion 520 of the side walls 20 and 22, the folds 92 and 94 of the arms 601 and 603 extend substantially parallel to each other symmetrically about the central plane 35. Below the portion 520, the folds 92 and 94 diverse outwardly forming a triangulated truss like structure, providing strength and resistance to deformation and assisting to rigidly support the bottom wall 36 substantial normal to the central plane. Similarly, above the portion 520 the folds 32 and 94 diverse outwardly forming a triangulated truss like structure, assisting to rigidly support the top wall 26 substantially normal to the central plane.

Figure 13:
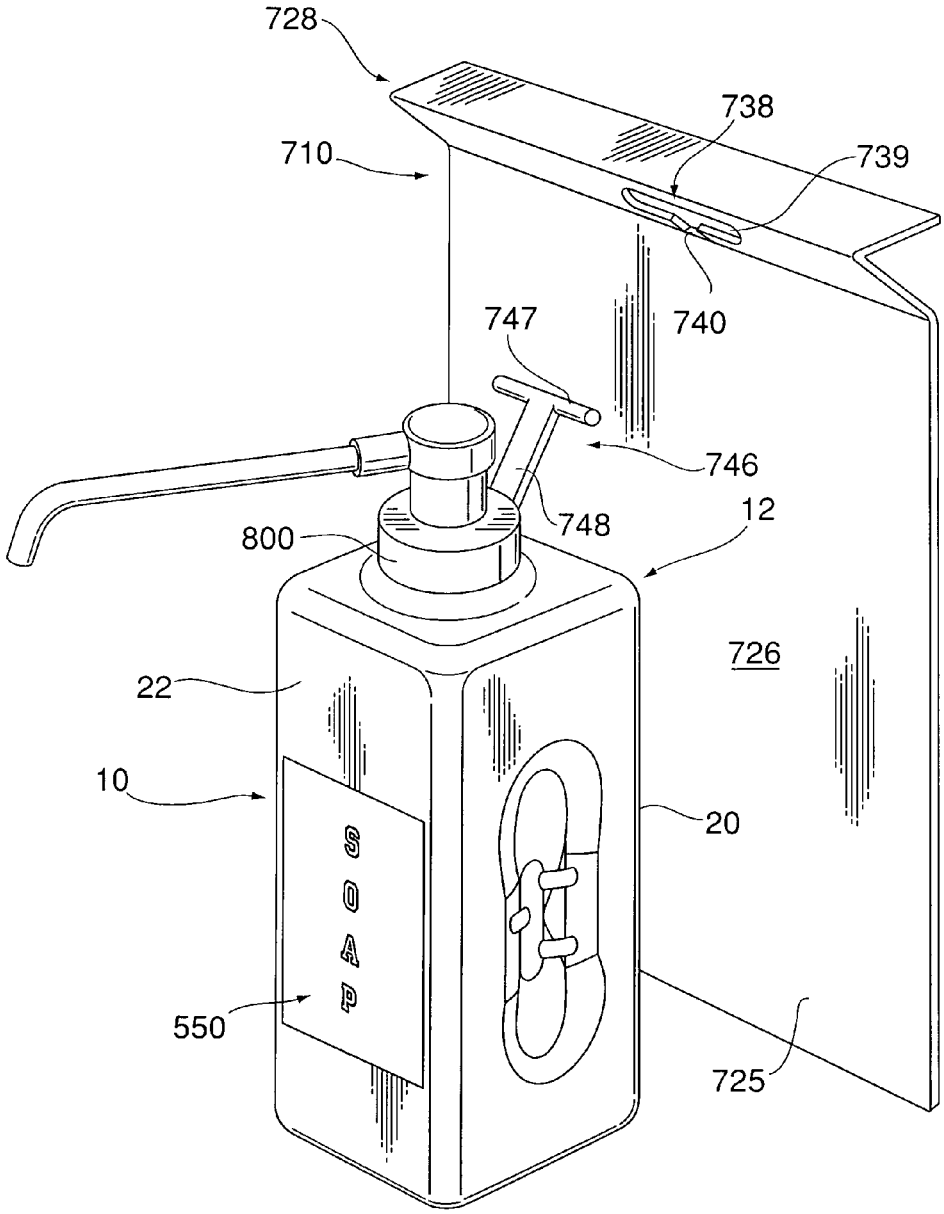
FIG. 13 is a partially exploded view of the bottle and wall plate shown in FIG. 12.

The longitudinal portion 520 of the side wall 16 is indicated by the cross-hatched label area 550 on FIG. 13. This area 550 and a corresponding area on the rear wall 18 is each a preferred area to carry labelling information about the material in the bottle to be dispensed since the area 550 is effectively always disposed to be substantially parallel to the central plane 35 in all uncollapsed and collapsed positions of the bottle.

As seen in FIGS. 9 and 10, a central channelway 556 is provided longitudinally of the bottle between the channel members 80. As seen in FIG. 11, two apex channelways 557 and 558 are provided inward of the central folds 90 and 91 where the tension in the side walls 20 and 22 of the bottle effectively keeps the side walls apart. The channelway 556 will continue to some extent from each end of the each channel member 80 towards the base end or outlet end. The apex channelways 557 and 558 will extend to provide communication with the channelway 556 at one end and the base end or outlet end at the other. Thus the channelway 556 and the apex channelways 557 and 558 provide for communication longitudinal through the entire length of the bottle in all collapsed and uncollapsed positions as is advantageous to ensure that substantially all fluid in the bottle may be withdrawn in a manner as taught in the applicant's U.S. patent publication US 2006/0032865, published Feb. 16, 2006, the disclosure of which is incorporated herein by reference. Each side channel members 82 provides a shunt channelway therein extending from the channelway 556 laterally. These side channel members 82 together with the channel 556 provide lateral shunt passages towards ensuring that compartment portions of the bottle on each side of the central plane 35 maintain in communication laterally to assist in ensuring that all fluids in the bottle may be withdrawn. As seen in FIG. 5, these compartment portions comprise a first compartment 591 and a second compartment 592. The first compartment 591 is on a first side of the central plane 35 and the second compartment 592 is on a second side of the central plane 35. The first compartment 591 is defined on a first side of the central channelway 556 bounded by an interior of the side wall 20 and an interior of the left front valley side wall 51 and an interior of the opposed left rear valley side wall indicated as 751. The second compartment 529 is defined on a second side of the central channelway 556 bounded by an interior of the side wall 22 and an interior of the right front valley side wall 52 and an interior of the opposed right rear valley side wall indicated as 752.

The side channel members 82 assist with the channel members 80 in stiffening the front wall 16 and rear wall 18, particularly when fully collapsed in which the side channel members 82 will assume positions as seen in FIG. 7 in solid lines and schematically illustrated in FIG. 9 in dashed lines.

On advantageous use of a bottle in accordance with the present invention is as a collapsible dispenser which is self supporting by having its base end engaged on a support surface 44 as seen in FIG. 6 whether uncollapsed as seen in FIG. 6 or when collapsed as seen in FIGS. 7 to 9.

Another advantageous use of a bottle in accordance with the present invention is with its outlet end 12 secured as in a dispenser or to a wall and with the base end 14, in collapsing of the bottle on dispensing fluid, being drawn upwardly.

Preferably one of the sides walls 20 or 22 will be directed towards a user, as for example, away from a wall and labelling 550 carried on the portion 520 over the exposed side will be visible for reading in all collapsed and uncollapsed conditions.

The bottle in accordance with the present invention substantially does not increase its cross-sectional area normal to the longitudinal as it collapses and the bottle may be used inside dispensers having an interior cavity designed to receive a rigid non-collapsible bottle of similar cross-sectional shape and size as a bottle in accordance with the present invention.

Preferably the bottle may be suspended by its outlet end 12 in a dispenser. More preferably when the bottle is suspended by its outlet end 12, one of the sides 20 and 22 will be directed towards a use to carry labelling on the portion 500 and the other of the sides 20 and 22 will be adjacent a vertical support surface or wall for engagement by such other side 20 or 22 where uncollapsed and/or by the ends of the fold lines 512 or 513 and 516 or 518 seen in FIG. 7 towards assisting in keeping the bottle disposed vertically and any labelling vertical and visible.

An advantage of the bottle in accordance with the present invention is that the bottle is substantially rectangular in shape and has but minimal inward protrusion of the front and rear valleys, such that the volume of the fluid retained inside the bottle is a large proportion of the overall volume represented by the overall width, depth and length of the bottle.

The bottle in accordance with the present invention is preferably disposable for one time use and made to have the pump assembly 100 secured to the bottle against removal to prevent unauthorized tampering or refilling which could result in contamination.

The bottle is preferably to be used in a manner to collapse the bottle with a vacuum developed inside the bottle on dispensing, however the bottle may also be used as a non-collapsible bottle by permitting air to replenish fluid dispensed.

The base end 14 has a three dimensional structure formed by its bottom wall 36 having the central portion 38 and the peripheral edge portions 40 to be sufficiently strong to resist deflection when collapsed. As seen in FIG. 9, the distance of the central fold 90 of the front wall 16 and the center fold 91 of the rear wall 18 to the longitudinal 34 varies increasing toward the base end and increasing toward the outlet end. As seen in FIGS. 10 and 11, the front wall 16 is folded where it merges with the side wall 20 at a fold 92 and is folded where it merges with the side wall 22 at fold 94. Similarly, the rear wall 18 is folded at fold 93 where it merges with the side wall 20 and is folded at fold 95 where it merges with the side wall 22. The fold lines 90, 92 and 94 and the set of fold lines 91, 93 and 95 effectively represent a forced deformation of the valley end walls 56 and 57 represented by the curved portions 76, 77, 78 and 79 as shown in FIG. 4. As seen in FIGS. 7, 10 and 11, as the folds 92,94 and 93,95 become closer to the base end 14, the folds diverge from the central plane 35 so as to join with the corners of the rectangular base end 14. As seen in FIG. 9, the center folds 90 and 91 diverge outwardly towards the base end 14. This divergence in the double layers forming at the folds 92,94 and 93,95 provide effectively a triangular truss structure which assists to form on the side of the bottle as seen in FIG. 7, a relatively rigid three dimensional structural triangle which tends to provide rigidity to the collapsed bottle. A similar three dimensional triangular truss structure is formed on the other side with the collapsed rear wall 18.

The outlet end 12 has a three dimensional structure formed by its top wall 26 including its central portion 28, axially extending neck 30 and peripheral edge portions 32. This three dimensional structure is provided to be sufficiently strong to substantially resist deformation and maintain its peripheral edge portions 32 substantially in the same positions relative to the neck 30 on collapsing of the container. In an analogous manner to that described with reference to the folding of the front wall 16 to form a triangular reinforcing truss with the base end 14, the front wall 16 similarly adopts an imaged folded structure forming a reinforcing triangular truss structure with the outlet end 12 as seen in FIG. 8.

In respect of the base end 14 having a three dimensional structure to resist deformation, it is preferred that the central portion 38 of the bottom wall 36 is inwardly convex and the peripheral edge portions 72, 68, 73, 71, 74, 69, 75 and 70 about the central portion 38 are inwardly concave rounded edge portions as shown. As best seen in FIGS. 3 and 9, the central portion 38 of the base end bottom wall 36 is concave as seen in side view perpendicular to the central plane 35.

The configuration of the base end valley end walls are advantageously selected so as in collapse of the bottle, the relative stresses applied to the front wall 16 and the rear wall 18 will come to be distributed relatively evenly about the center longitudinal plane on each of their folds 92/94 and 93/95 and the portions of the side walls and front or rear wall involved in these folds. Preferably, the walls of the bottle are formed to be of a material having a thickness which is uniform or at least uniformly symmetrical about the central plane 35 so that the valley side walls 51 and 52 and the base end valley end wall 58 as well as the outlet end valley end wall 56 will serve to develop stresses uniformly, notably, on each of the folds 91 and 93 on the front wall and similarly on folds 92 and 94 on the rear wall. With such uniform tensioning and deformation of the front wall 16 and rear wall 18 and with the base end 12 having a relatively uniform resistance to deformation, at least symmetrically about the longitudinal central plane 35, withdrawal of fluid from the bottle, the bottle has an inherent tendency to collapse in a symmetrical manner and develop on collapsing a reinforced triangular truss-like structures which serves to maintain the collapsed bottle generally symmetrical about the central plane 35 and maintain the base end 14 and notably its support portions 42 and 43 in a flat plane which is perpendicular to the central plane 35.

Similarly, the outlet end 12, particularly by reason of being reinforced by its coaxial generally cylindrically extending neck 30, resist deformation and with symmetrically directed stresses being developed with triangular folding collapse of the outlet end portions of the front wall 16 and rear wall 18, in the collapsed bottles, the folds developed in the front wall 16 and rear wall 18 provide for maintaining the outlet end 12 disposed normal to the central longitudinal plane and supported by the collapsed folded front wall 16 and rear wall 18 with its peripheral edge portions in substantially the same positions relative to the neck 30 on collapsing of the bottle.

Through the middle of the collapsed bottle as seen in FIG. 8, the apex channel member 80 in each of the front valley 50 and the opposed rear valley in being inwardly concave provide a longitudinal support member resisting deflection of the folded front wall 16 and folded rear wall 18 out of a configuration in which they are aligned about the center plane 35. In addition, each of the side channel members 82 serve a stiffening purpose tending to resist folding of the left and right valley side walls upon themselves assisting in distributing forces tending to fold the front wall 16 and rear wall 17 over broad areas so as to resist localized folding or deformation which might tend to cause one area of the front wall 16 or rear wall 18 to collapse in a non-symmetrical manner relative to the central plane 35.

The fact that each valley end wall presents a generally frusto-conical surface symmetrical about the central plane 35 and curving approximately 180° provides a structure which assists in uniformly distributing the forces in collapse of the bottle in a manner distributing the forces uniformly onto the opposed folds such as 93 and 95 or 92 and 94.

The particular shape of the curve formed by the valley end walls at least where they intersect with the central portions of the front wall and rear wall is to be selected by a person skilled in the art bearing in mind the relative proportion of the bottle, that is, the length and width of each of the front and rear panels and the length and width of each of the side walls. For example, insofar as the bottle had a reduced longitudinal extent but the same width and depth, then the lines 220 and 223 may preferably be reduced in dimension along the longitudinal.

Each valley end wall is shown as comprising two portions, for example, in respect of the base end valley end wall 57, an outer portion 78 and an inner portion 79. This is not necessary, however, it is preferred to provide these two separate portions 78 and 79 disposed in different planes and at different angles as seen in FIG. 6 as another feature which assists to ensure that there is a three dimensional structure to the valley end wall which resists localized folding other than uniformly at the desired fold lines 91, 93 and 95 as discussed.

Figure 12:
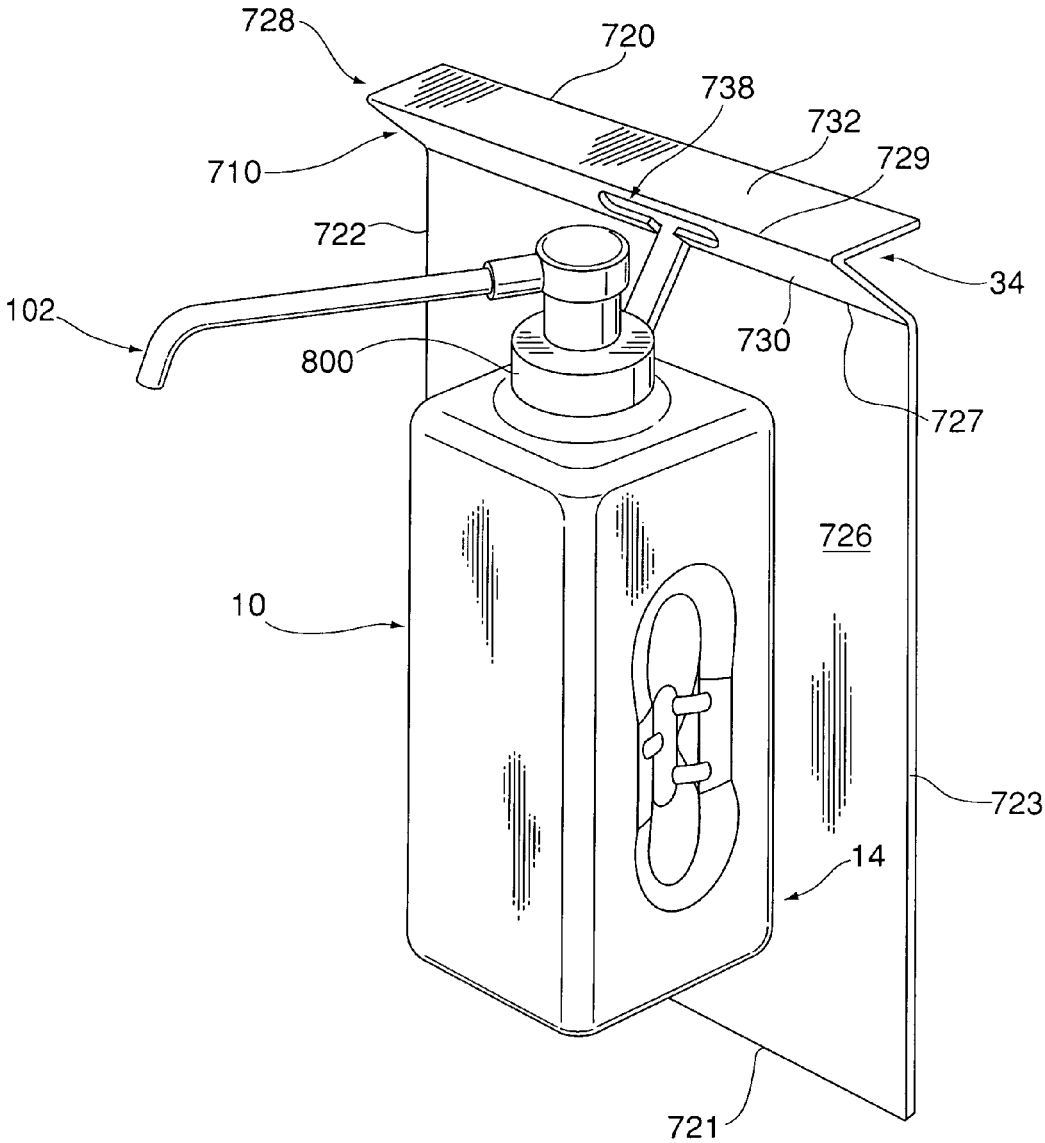
FIG. 12 is a pictorial view of the collapsible bottle similar to that shown in FIG. 1 as mounted to a wall plate.
Figure 14:
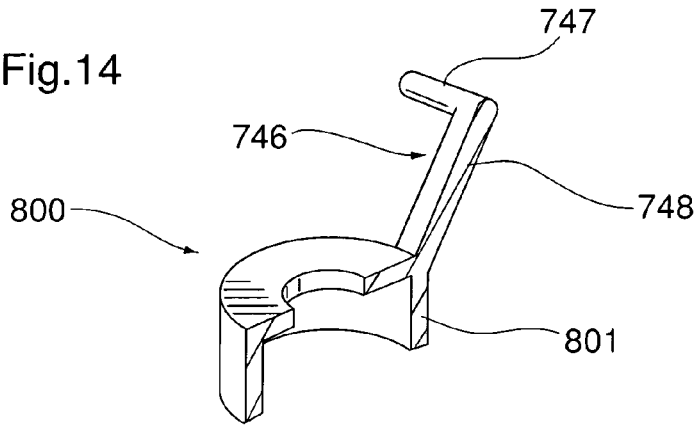
FIG. 14 is a schematic cross-sectional view of a portion of the cap for the bottle shown in FIGS. 12 and 13 in vertical cross-section through key member.

Reference is made to FIGS. 12 to 14 which illustrate a bottle substantially shown in FIG. 1 as coupled to a wall plate system of the type described in the applicant's U.K. patent application GB 2,427,120 published Dec. 20, 2006, the disclosure of which is incorporated herein by reference. FIG. 12 shows the wall plate 710 as having an upper edge 720, lower edge 721 and side edges 722 and 723. The wall plate 710 illustrated is formed from a unitary sheet of metal. The wall plate 710 has a plate portion 726 which extends between side edges 722 and 723 from the lower edge 721 to a first fold line 727. The wall plate 710 has a securement portion 728 which compromises the wall plate 710 from the first fold line 727 between the side edges 722 and 723 to the upper edge 720. The wall plate extends from the first fold line 727 forwardly and upwardly at a diagonal to a plane in which the plate portion 726 lies to a second fold line 729 and hence from the second fold line 729 rearwardly and upwardly at an angle to the upper edge 720. The upper edge 720 is disposed in the same plane as a plane through a rear surface of the plate portion 726.

The securement portion 728 is in the form of a channelway member extending longitudinally along the upper edge 720 of the wall plate open at its rear enclosed at its front by a lower flange 730 between the first fold line 727 and the second fold line 729 and an upper flange 732 between the second fold line 729 and the upper edge 720. The securement portion finds a channelway 34 therein.

A T-shaped key way opening 738 extends through the lower flange 32 into the slotway 34. The key way opening 38 has a generally T-shape in appearance with an enlarged width upper passage portion 739 and a reduced width lower catch portion 740.

The bottle 10 carries approximate upper end 12 a key member 746 generally in the shape of a "T" as seen in front view and having an enlarged width digital tab portion 747 sized to pass through the upper passage portion 739 of the key way opening 738 however of a sufficient width to not pass through the lower catch portion 740 of the key way opening 738. The distal tab portion 747 is connected to the bottle 10 via bridge portion 748 sized to be of a width less than the width of the lower catch portion 740 of the key way opening 742. To couple the bottle 10 to the wall plate 710, the bottle 10 is manually manipulated in positions such that distal tab portion 747 of they key member 746 is passed through the upper passage portion 739 of the key way opening 738 into the channelway 734 and then moved downwardly inside the channelway 734 with the bridge portion 748 of the key member 746 extending through the lower catch portion 740 of the key way opening 738 and the distal tab portion 747 engaging the rear of the lower flange 730 in the channelway 734 on either side of the lower catch portion 740 of the key way opening. With the key member 736 so engaged in the key way opening 738, the bottle 10 may be released and will hang supported at its upper end 12 by the key member 746 being engaged in the key way openings 734. The bottle 10 hangs vertically downward with its side surface 20 planar with the forward surface 725 of the plate portion 726.

In the embodiment illustrated in FIGS. 12 and 13, the piston pump assembly 100 includes a cap 800 adapted to removably engage about the upper opening of the bottle. This cap is shown schematically in FIG. 14 in a cross-section pictorial view showing the cap as having a cylindrical side wall 801 and the bridge portion 748 is intricately formed therewith as for example by injection moulding from plastic.

Figure 15:
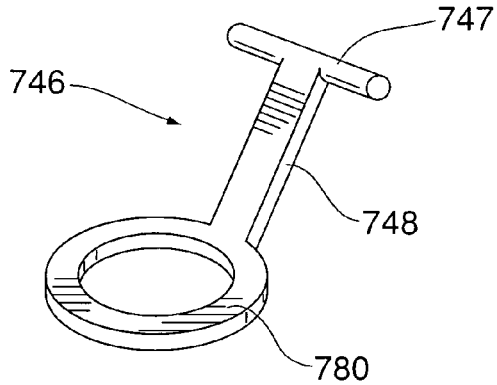
FIGS. 15 and 16 are alternate embodiments of key members for securing a bottle to a wall plate as shown in FIG. 13.

FIG. 15 shows an alternate embodiment in which the key member 746 is provided at one end of the bridge portion 748 with an annular securing ring 780 adapted to be engaged annularly about an outlet of the bottle and an annular shoulder provided on the bottle or the cap to be secured to the bottle. The embodiment in FIG. 14 the key member 746 may be made from relatively flexible plastic material.

Figure 16:
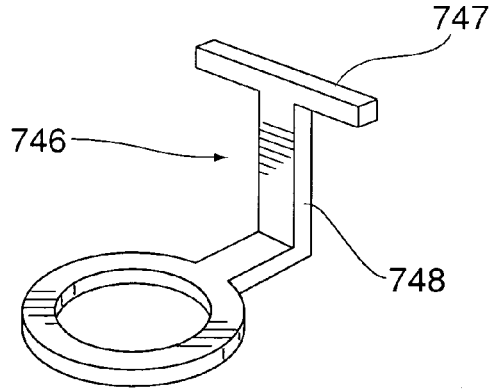

Reference is made to the embodiment in FIG. 16 which shows another embodiment of a key member 746 however in which the key member may be provided to be rigid as for example stamped from metal. The key member has its bridge portion 748 than to form a right angle so that the bridge member may extend vertically downwardly adjacent the plate portions 726 of the wall plate 710 and then horizontally outwardly.

Figure 17:
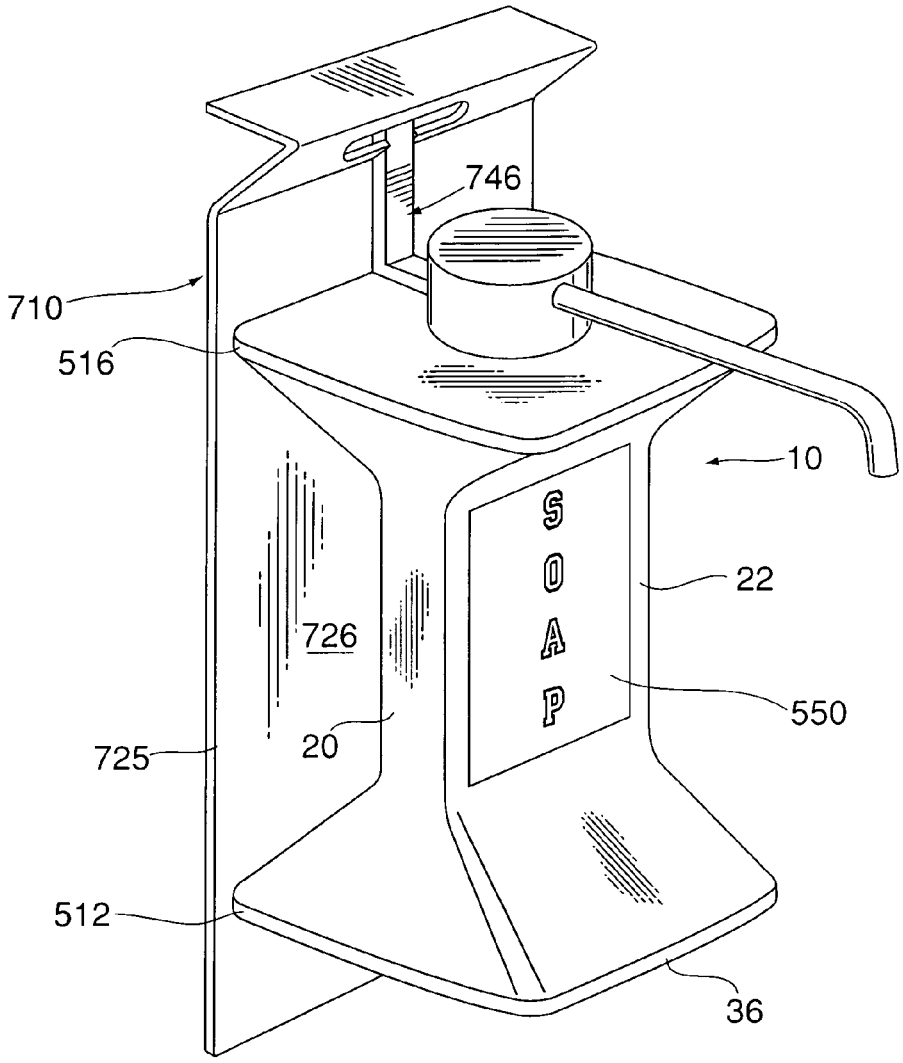
FIG. 17 is a schematic pictorial view showing an embodiment similar to the embodiment of FIG. 12 with a bottle in a partially collapsed condition.

Reference is made to FIG. 17 which illustrates a bottle similar to that shown in FIG. 13 as mounted to a similar wall plate 710 via key member 746 similar to that shown in FIG. 16 and with the bottle being in a partially collapsed condition. The bottle 10 is shown partially collapsed and with the folds 516 and 512 of the side wall 20 engaging the forward surface 725 of the plate portion 726 so as to the hold the bottle substantially vertically. As can be seen, labelling indicated in the area 550 on the side wall 22 is directed forwardly and remains visible to a user.

While not necessary, various mechanisms may be utilized to hold the lower portion of the side wall against the plate portion 726. For example a magnet may be secured to the side wall 20 approximate where the side wall forms its fold 512 which magnet while being attracted to metal of the wall plate would not have sufficiently great strength to inhibit the bottle 10 from being collapsed in length and the fold 512 moving upwardly on the plate portion as fluid is dispensed.

Figure 18:
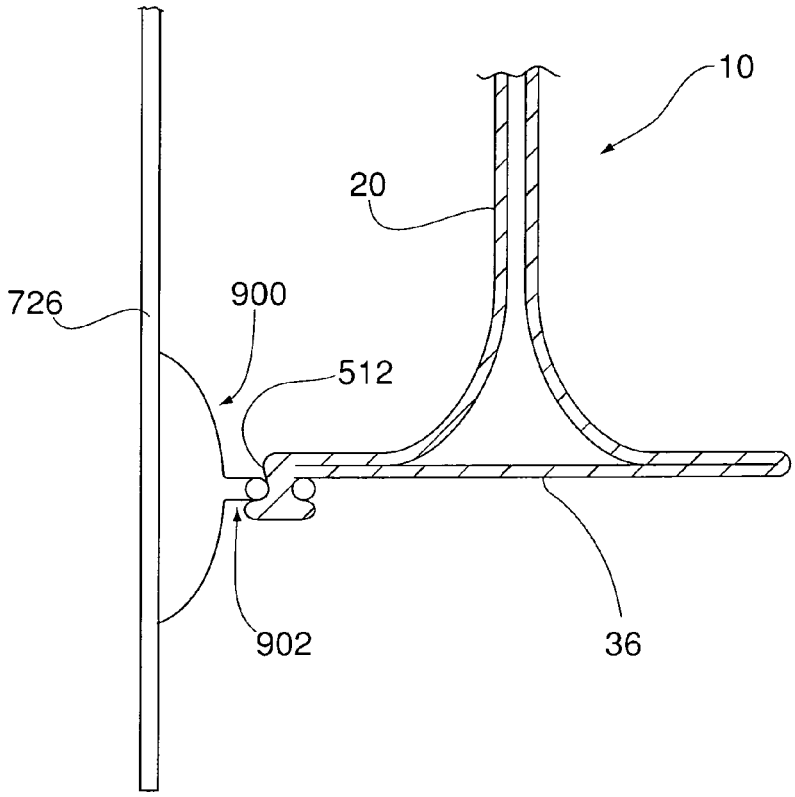
FIG. 18 is a partial side view of the embodiment of FIG. 17 but additionally showing the use of a suction cup.

Similarly, as seen schematically in FIG. 18 suction cup 900 mechanism could be provided to secure the base end of the side wall 20 as with a flexible or extendable connection member 902 to permit length reduction of the bottle 10 as fluid is dispensed accommodating for relative movement relative the suction cup 900 secured to plate portions 726. The suction cup 900 may alternatively be provided so as to permit sliding vertically on the plate portion 726 without disengagement.

In use of the bottle 10 and the embodiments illustrated in FIGS. 12, 13 and 17 it is to be appreciated that it is not necessary that the bottom wall 36 strictly speaking be maintained perpendicular to the central plane 35. In the embodiment for example is illustrated in FIG. 17, the fact that the bottom wall extend somewhat horizontally rearwardly from the substantially vertically disposed portions of the side walls 20 and 22 will permit the bottle to be supported at an acceptable orientations that the labelling on the side wall 22 of the bottle may be viewed.

Reference is now made to FIGS. 19 to 26 illustrating embodiments of the present invention in which a collapsible bottle is provided in combination with a bottle cover so as to provide advantages including by the interaction of the collapsible bottle and the cover a visual indication as to the extent to which the container is full or empty as well as advantageous arrangements for mounting of the collapsible bottle.

Reference is made first to FIGS. 19 to 23 which illustrate a first embodiment of a bottle cover 810 in accordance with the present invention. As shown, the cover 810 has a top panel 811, a front panel 812, two side panels 813 and 814 and a rear panel 815. In the first embodiment, the cover 810 comprises a sleeve and is open at a bottom opening 816. A neck receiving circular opening 817 is provided in the top panel 811.

Figure 20:
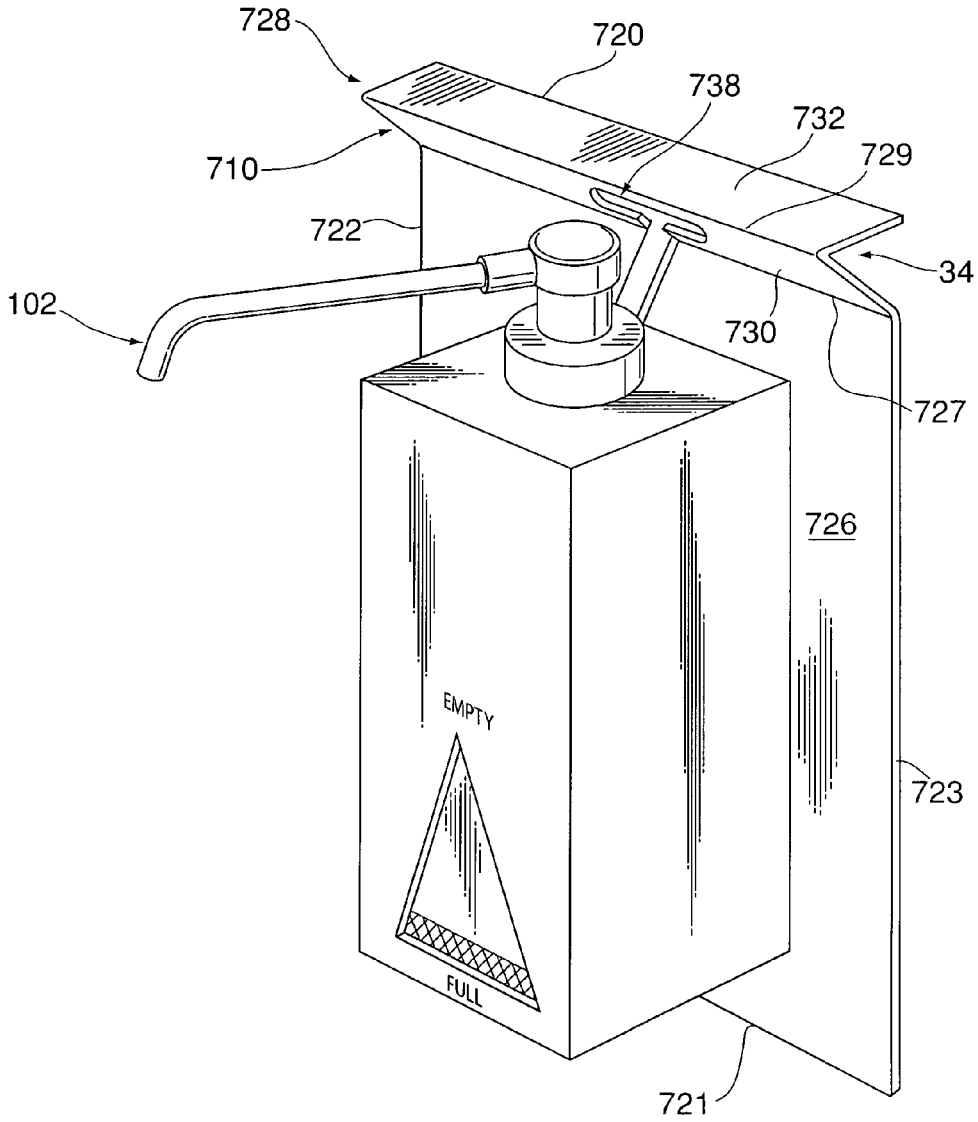
FIG. 20 is a pictorial assembled view of the cover shown in FIG. 19 mounted to the bottle, in turn, mounted to the wall plate and with the bottle in a full condition.
Figure 21:
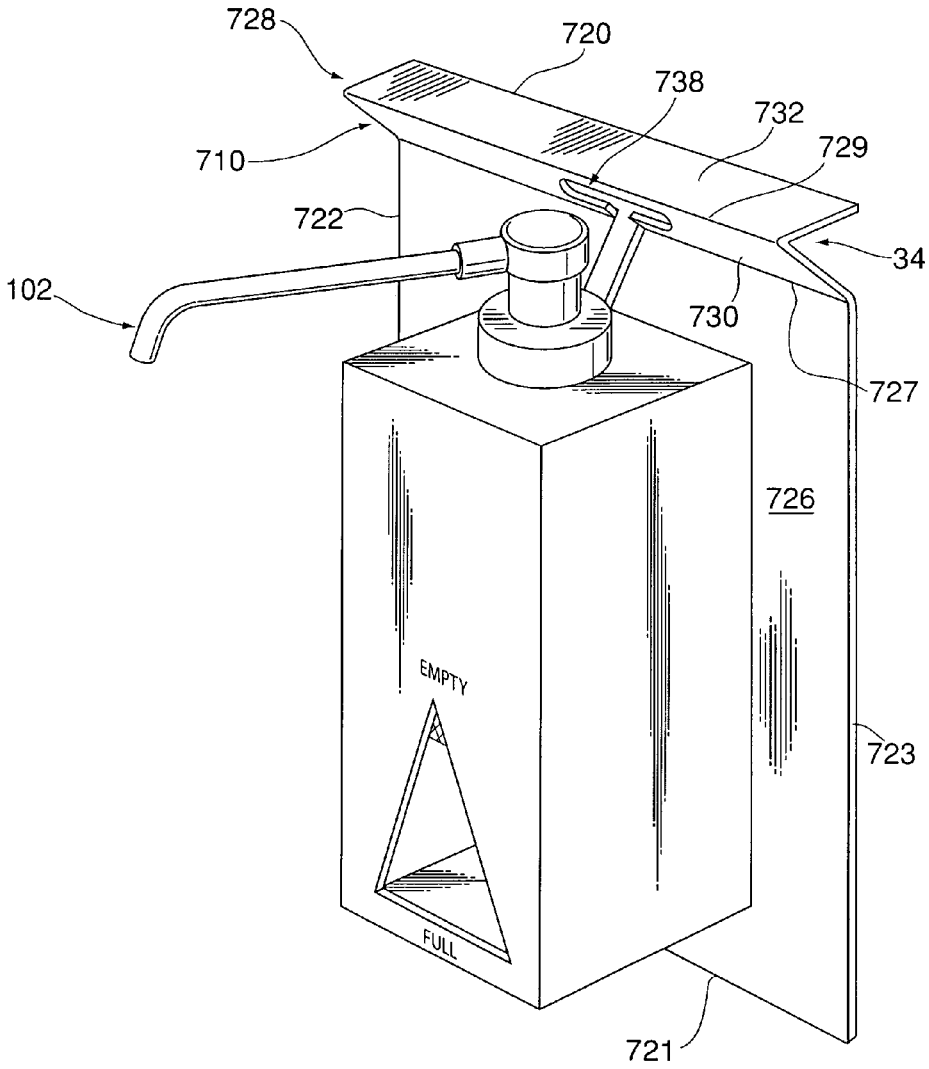
FIG. 21 is a pictorial view the same as in FIG. 20, however, after fluid has been dispensed from the bottle such that the bottle is in an empty condition.
Figure 22:
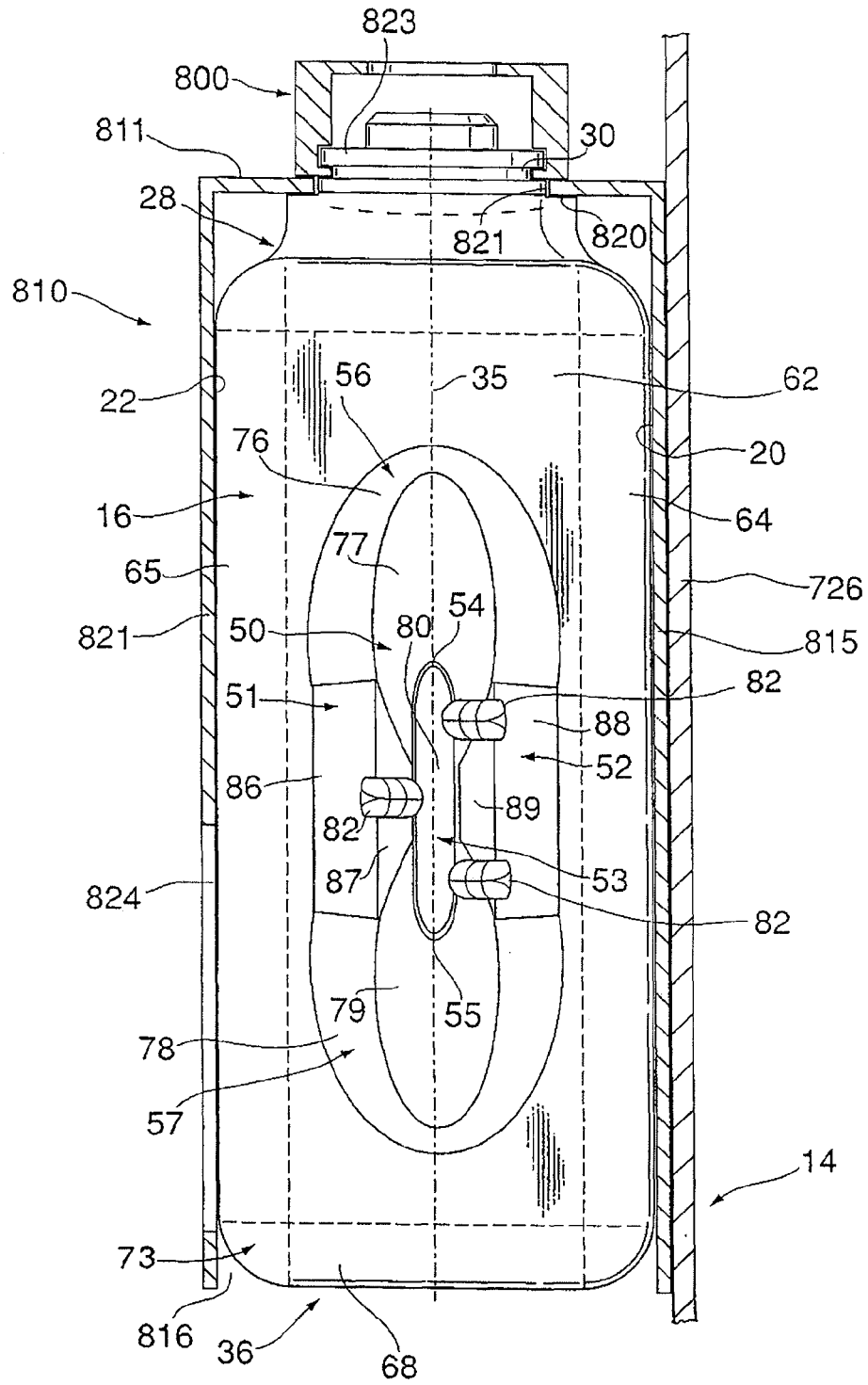
FIG. 22 is a schematic cross-sectional side view of FIG. 20 from the right side showing the bottle in side view and the cover and a portion of a securing cap each in side view and with the bottle in a full condition.
Figure 23:
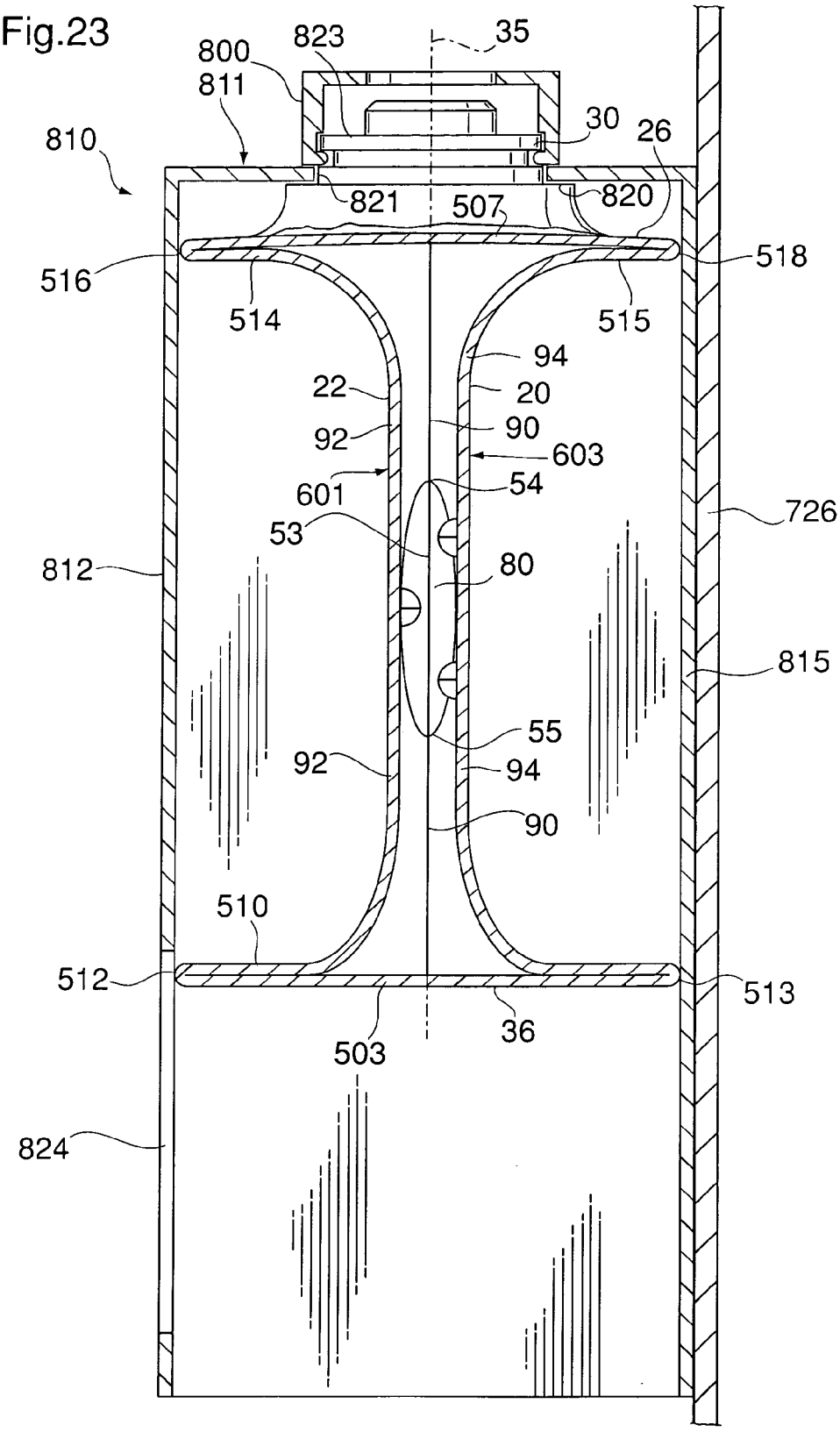
FIG. 23 is a cross-sectional side view the same as that shown in FIG. 22 but with the bottle in a collapsed empty condition.

The bottle 10 shown in FIGS. 19 to 23 is identical to the bottle 10 shown in FIG. 12 with the exception that, as best seen in side view in FIGS. 22 and 23, a second shoulder 820 is provided on the bottle ending at an axially extending neck portion 821 sized to be received inside the circular opening 817 of the top panel 811. As seen in FIG. 22, the cap 800 is shown to be received in a snap-fit inside an annular channel about the neck 30 disposed axially under an annular flange 823. The cap 800 is schematically shown as adapted to be snap-fitted onto the neck so as to securely retain the top panel 811 onto the bottle engaged on the shoulder 820. The cover 810 is sized such that the front panel 812 and the rear panel 815 lie outwardly of the side wall 22 and the side wall 20 of the bottle, respectively.

Figure 19:
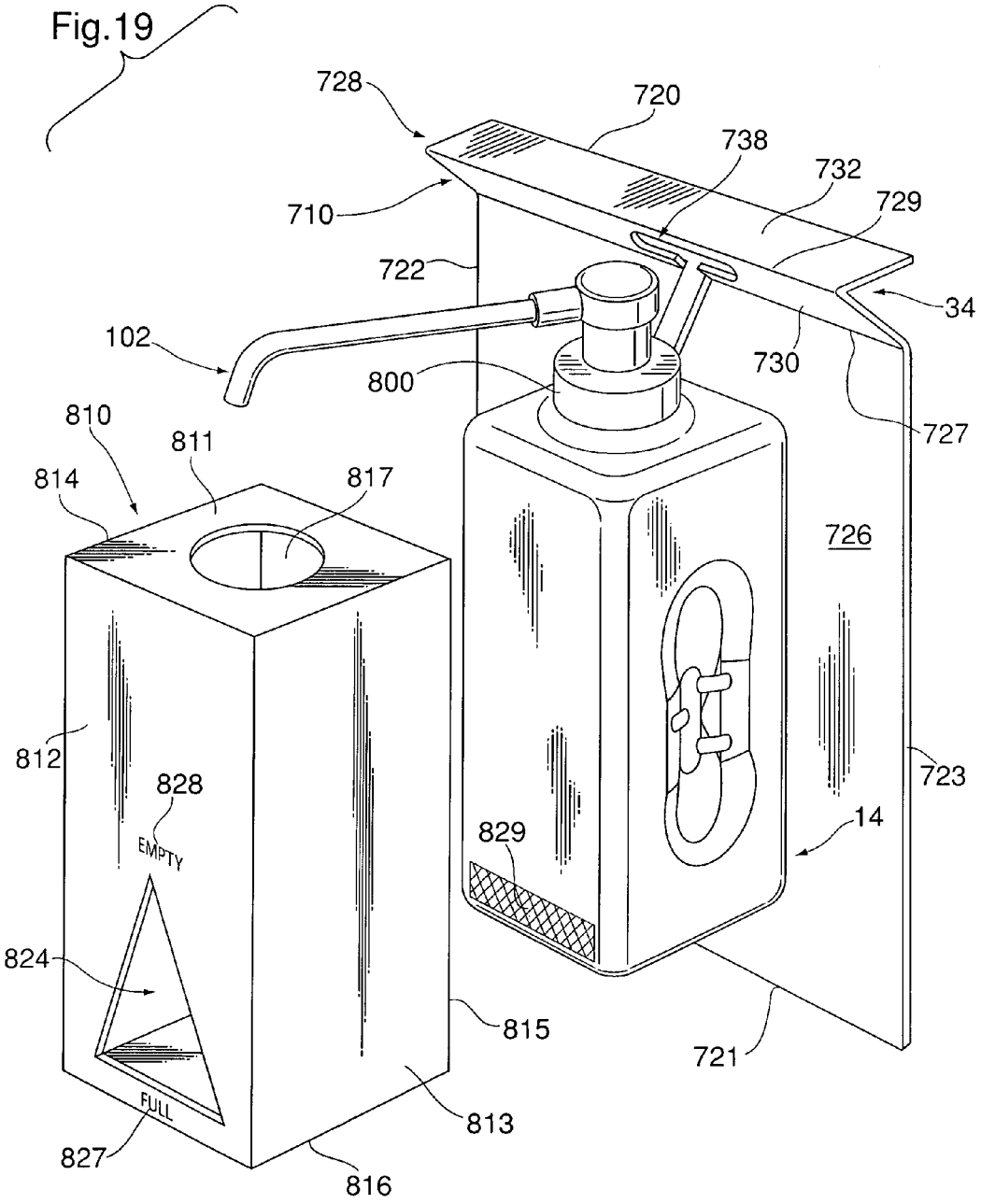
FIG. 19 is an exploded view showing the collapsible bottle of FIG. 12 mounted to a wall plate in combination with a first embodiment of a bottle cover.

The front panel 812 includes a sight opening 824 as best seen in FIG. 19 as comprising a triangular shape. Indicia are printed on the front panel 812 showing the indicia 827 of the bottom as "Full" and the indicia 828 at the top indicating "Empty". As best seen in FIG. 19, the bottle carries visual indicia 829 preferably comprising a colour band marked on the side 22 of the bottle proximate the lower corner. This indicia is shown in the form of a colour band of contrasting colour, preferably red, compared to the adjacent surfaces of the bottle 10.

The cover 810 is configured to have an interior space which permits the bottle 10 on dispensing of fluid from the bottle to move from a full uncollapsed position as shown in FIGS. 19, 20 and 22 to a collapsed position as shown in FIGS. 21 and 23. As is to be seen in a comparison of FIGS. 22 and 23, in collapsing of the bottle, a lower corner 64 which forms the fold 512 is drawn upwardly. Since this fold 512 is marked with the different coloured indicia 229, this fold becomes readily, visually distinguishable in the sight opening 824 and the relative location of the fold 512 in the sight opening provides a visual indicator as to the extent to which the bottle is full or empty.

The cover 810 illustrated in FIGS. 19 to 23 may be formed of relatively lightweight but rigid materials such as cardboard, plastic material and the like such that the front panel 218 will retain a relatively rigid shape and locate the sight openings 824 as a desired reference point relative to the bottle neck 30. The cover 810 in being fixed relative its location to the neck 30 serves to provide a visual reference point as to the extent to which the bottle in collapsing has drawn portions of the bottle underneath the neck 30 upwardly. Any collapsing bottle which collapses so as to draw portions of the bottle below the neck upwardly during collapse of the bottle can be used with a similar cover 810 as to provide the relative location of the upwardly drawn portions of the bottle relative to the cover as co-related to the extent to which the bottle is full or empty.

Figure 24:
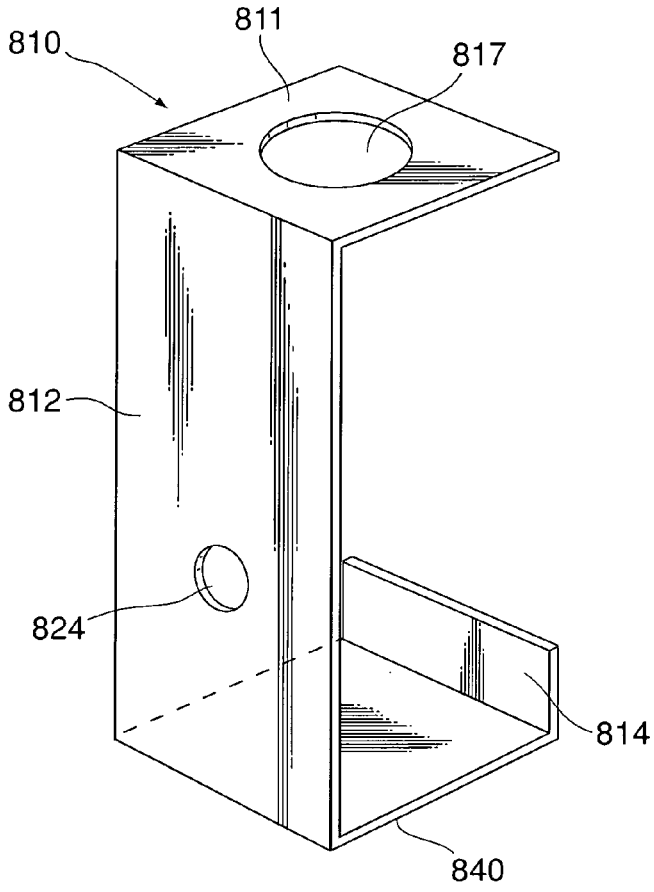
FIG. 24 is a pictorial view of a second embodiment of a cover adapted for replacement of the cover shown in FIG. 19.
Figure 25:
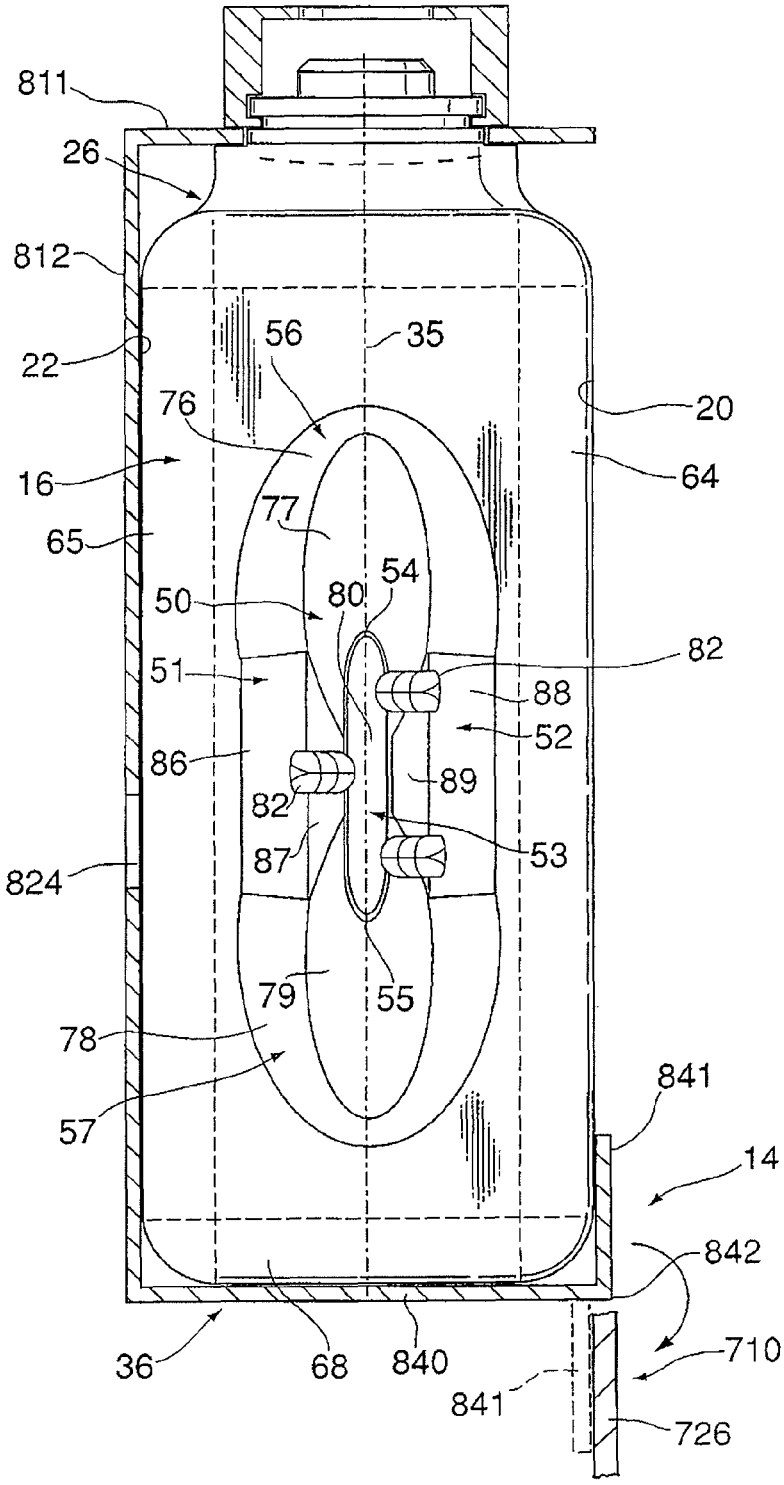
FIG. 25 is a cross-sectional side view the same as that shown in FIG. 22 but utilizing the second embodiment of the cover shown in FIG. 24.

Reference is made to FIGS. 24 and 25 which show a second embodiment of a cover 810 in accordance with the present invention. The second embodiment of the cover 810 has a top panel 811 identical to the top panel in the embodiment of FIG. 19, a front panel 812, a bottom panel 840 and a shortened rear panel 841. As seen in FIG. 25, the top panel 811 is secured to the bottle in the same manner as in the embodiment of FIGS. 19 to 23. The front panel 812 extends downwardly in front of the side wall 22 and the bottom panel 840 extends closely underneath the base end 14 of the bottle 10 with the rear panel 411 extending upwardly over the side wall 20 of the bottle as shown in FIG. 25. The rear wall portion 841 is secured to the bottom panel 840 along a hinge line 842 such that the bottom panel 841 is adapted to be moved from an upwardly extending position shown in solid lines in FIG. 25 to a downwardly extended position as shown in dashed lines in FIG. 25. The rear panel 841 carries a releasable adhesive on one of its surfaces as seen in FIG. 25 for releasably coupling the rear panel 841 to the wall 20 of the bottle. In securing the bottle 10 and cover 810 of FIG. 25 to a wall plate of the type as shown in FIG. 19, the rear flap 841 is manually removed from engagement with the bottle wall 20 and rotated to the downward position shown in dashed lines such that the rear portion 841 is adhered to the forward surface of the plate portion 726 of the wall plate 710 shown in FIG. 19 and only schematically shown at the bottom of FIG. 25. The rear portion 841 thus assists in securing the front panel 811 of cover 810 in a desired configuration as supported rigidly at the upper end of the cover 810 by the top 811 being fixedly secured to the neck 30 and with the rear portion 841 being adhered to the plate portion 726 of the wall plate 710.

As an alternate embodiment of the cover 810 shown in FIG. 24, merely the top panel 811 and the front panel 812 need be provided.

The top panel 811 has been shown in both embodiments as secured between the cap 11 and the neck 30 of the bottle. This is not necessary. The top panel 11 could, for example, be adhesively secured to a flat upper surface of the bottle proximate the neck.

The embodiment of FIGS. 24 and 25 shows a second embodiment of a sight opening 824 which is shown as a round opening disposed on the front panel 812 at a height which when viewed substantially horizontally will view portions of the wall 22 which rise upwardly with collapse of the bottle. For example, in this embodiment, the surface 22 of the bottle 10 could be provided with a variance of colours at locations in a full bottle from above the sight opening 824 down to the lower corner 64 where the fold line 512 will form. Alternatively, merely the area of the wall 22 of the bottle as, for example, about the fold line 512 may be marked to be of a different colour such as, for example, red, which will come after a time to be visual through the sight opening 828.

Figure 26:
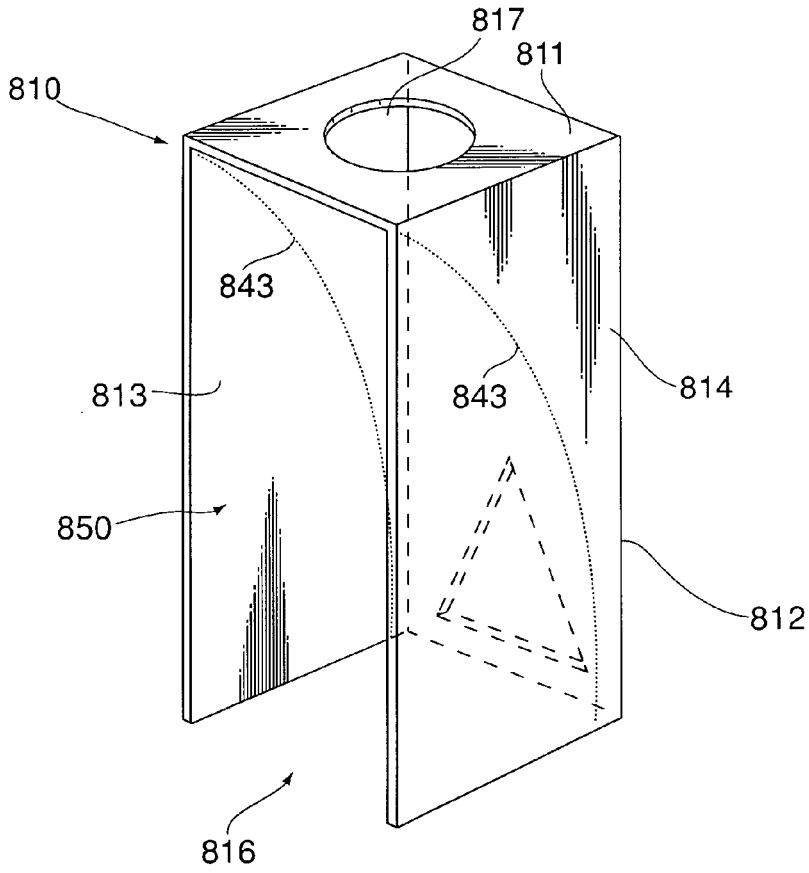
FIG. 26 is a pictorial rear view of a third embodiment of a cover adapted for replacement of the cover shown in FIG. 19.

Reference is made to FIG. 26 which shows a rear perspective view of a third embodiment of a cover 810 which is substantially identical to the first embodiment shown in FIGS. 19 to 23, however, in which the rear panel 815 is removed providing a rear opening 850. In the embodiment of FIG. 26, these two sides 813 and 814 provide for relative rigidity and location of the front panel 812. Each of the side walls 813 and 814 could be cut away or of reduced size as may be desired to reduce the use of materials. For example, each of the side panels 813 and 814 may be cut away as along the dotted lines 843 to reduce materials.

The cover as illustrated in FIGS. 19 to 26 may be provided of various materials. For example, they may be comprised from paper, cardboard, a fairly lightweight yet rigid plastic, or as a thin MYLAR sheeting which may be opaque or transparent as may be desired. Each of the covers 812 may also serve the purpose of carrying identifying indicia as to the fluid within the bottle 10 and, in this regard, each of the covers 810 are preferably secured to the bottle 812 against removal without damage or destruction.

Figure 27:
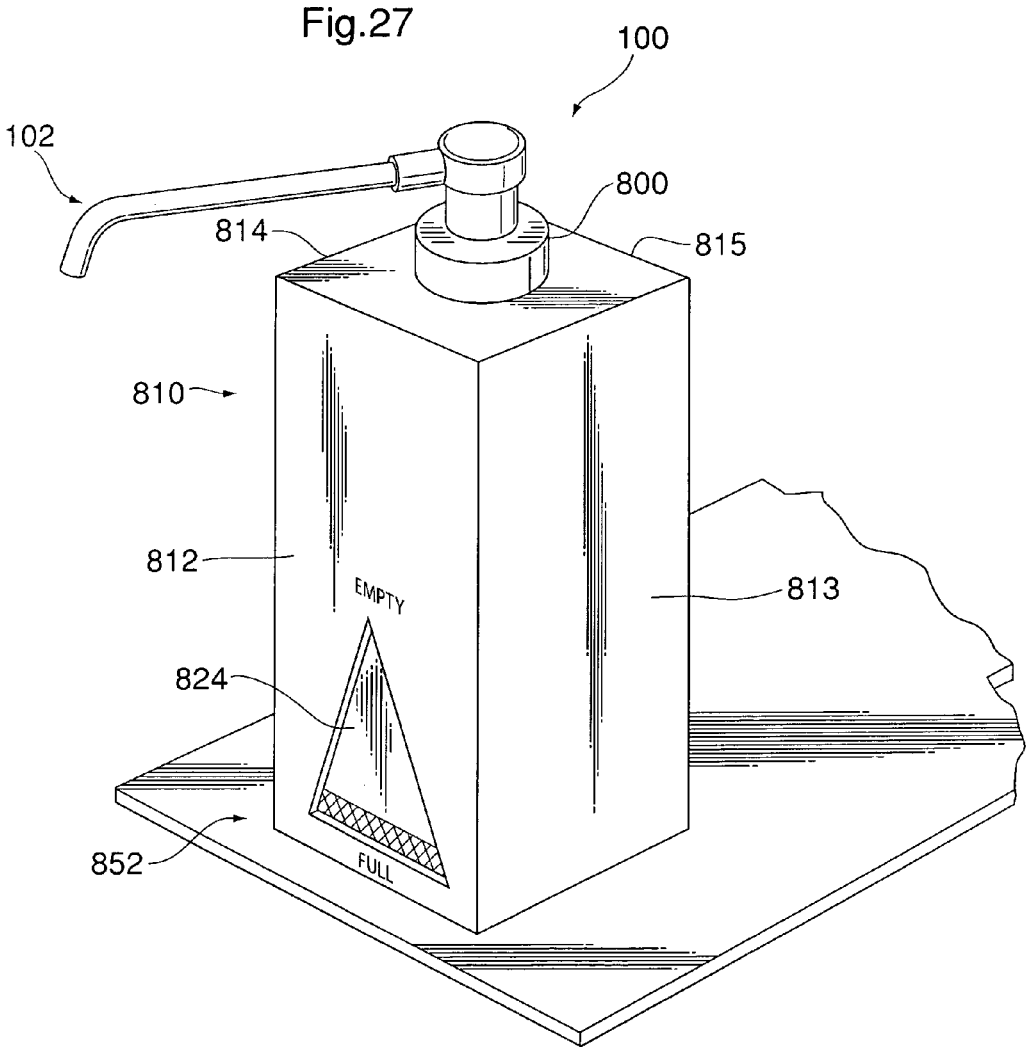
FIG. 27 is a pictorial view showing the bottle and cover of FIG. 19 as supported on a horizontal support surface.

Figure is made to FIG. 27 which shows a bottle 10 and cover 810 as illustrated in FIG. 19, however, in which the cap 800 no longer carries the key member 746 shown, for example, in FIGS. 12 and 19. The cover 810 is provided to have the lower edges of its front panel 812, side panels 813 and 814 and rear panel 815 disposed in the same plane as adapted to engage a planar support surface 852 such as a tabletop. The cover 810 is to be provided with sufficient strength to withstand manual forces to be applied downwardly to the piston pump assembly 100 to dispense fluid from the bottle. In the embodiment of FIG. 27, as in the other embodiments such as in FIG. 12, the neck 30 of the bottle is supported and the lower end of the bottle is drawn upwardly towards the neck providing a visual indication in the sight opening 824 as to whether or not the bottle is full or empty.

The cover 810 may be provided with varied shapes and configurations as may be visually pleasing. Cover 810 could, for example, be injection moulded from rigid plastic and the sight opening 829 could be filled in by clear plastic as in the manner of a window. Rather than being disposable, the cover 810 could be removably coupled to the bottle 10 as by removing the cap 800 and its piston pump assembly from the bottle, in which case, merely the bottle might be a removable and a replaceable component.

While in the configuration illustrated in FIG. 27, it is preferred that the sight opening be provided for a visual indication as to whether the bottle is full or empty, it is to be appreciated that this is not necessary. The cover 810 has advantages in providing a possibly more pleasing visual arrangement to the collapsible bottle particularly insofar as the collapsible bottle may comprise a relatively flimsy plastic bag which may not be visually attractive as it collapses yet provides an inexpensive disposable and sanitary vessel for soap. Thus, while it is preferred that an embodiment illustrated in FIGS. 19 to 27 will have a collapsible bottle which collapses to draw lower portions of the bottle upwardly to the neck on collapsing in a relatively predictable manner, this is not necessary and the present invention includes embodiments in which a cover as, for example, is shown in FIG. 27, may be used with a collapsible bottle or a collapsible bag which may collapse in a relatively random manner albeit preferably one which does not trap fluid within the bottle or bag from being dispensed.

In the preferred embodiments described with reference to FIGS. 19 to 26, the sight opening 224 is provided and is preferably presented with a view of either the side wall 22 or the side wall 20 of the bottle 10. However, it is to be appreciated by a person skilled in the art that the invention could also be used with the sight opening 224 sighting portions of either of front wall 16 and rear wall 18 which may be suitably coloured or otherwise have indicia making it distinguishable from the remainder of the bottle. For example, the indicia could be the fold line 503 as shown in FIG. 23 or portions of the fold lines 92 or 94 which may be suitably coloured or other portions of the front wall 16 or rear wall 18 of the bottle which are suitably visually distinguishable by indicia or other features.

Figure 28:
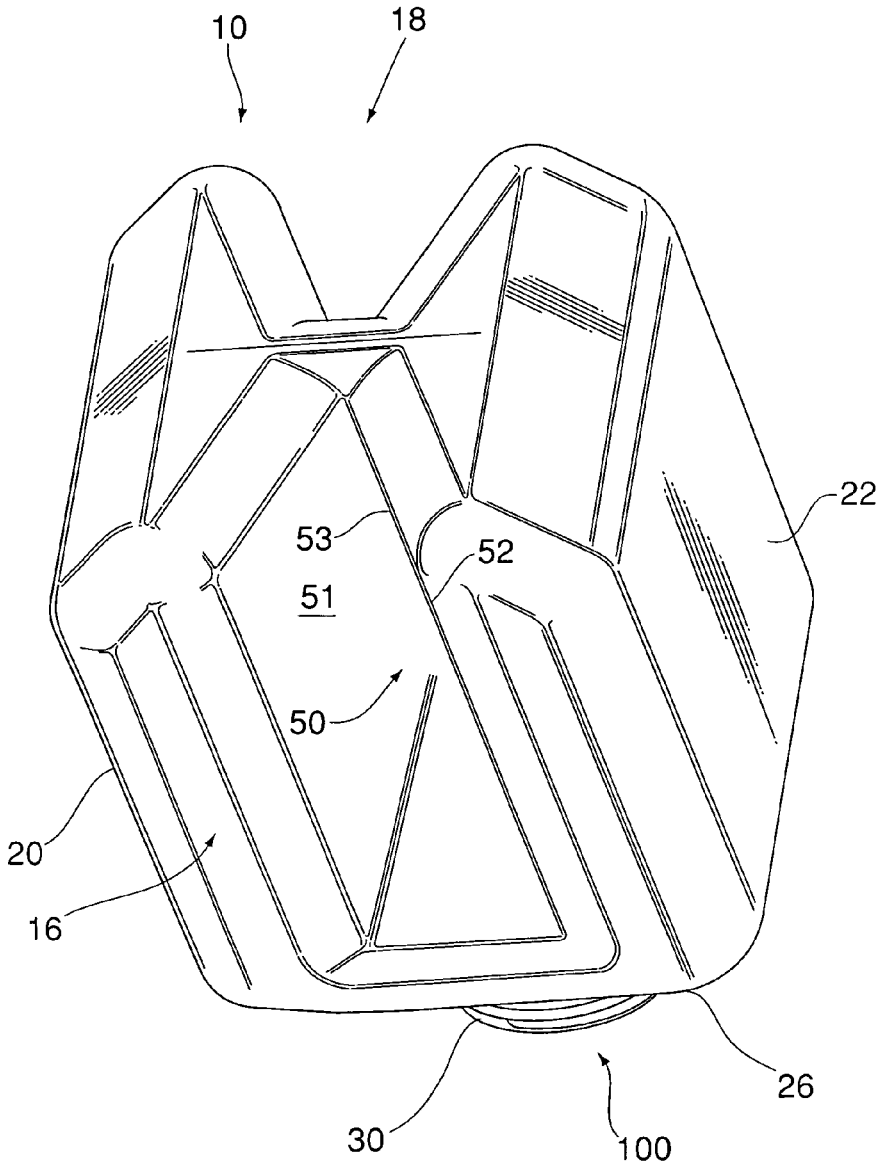
FIG. 28 is a perspective view showing a second embodiment of a collapsible bottle.
Figure 29:
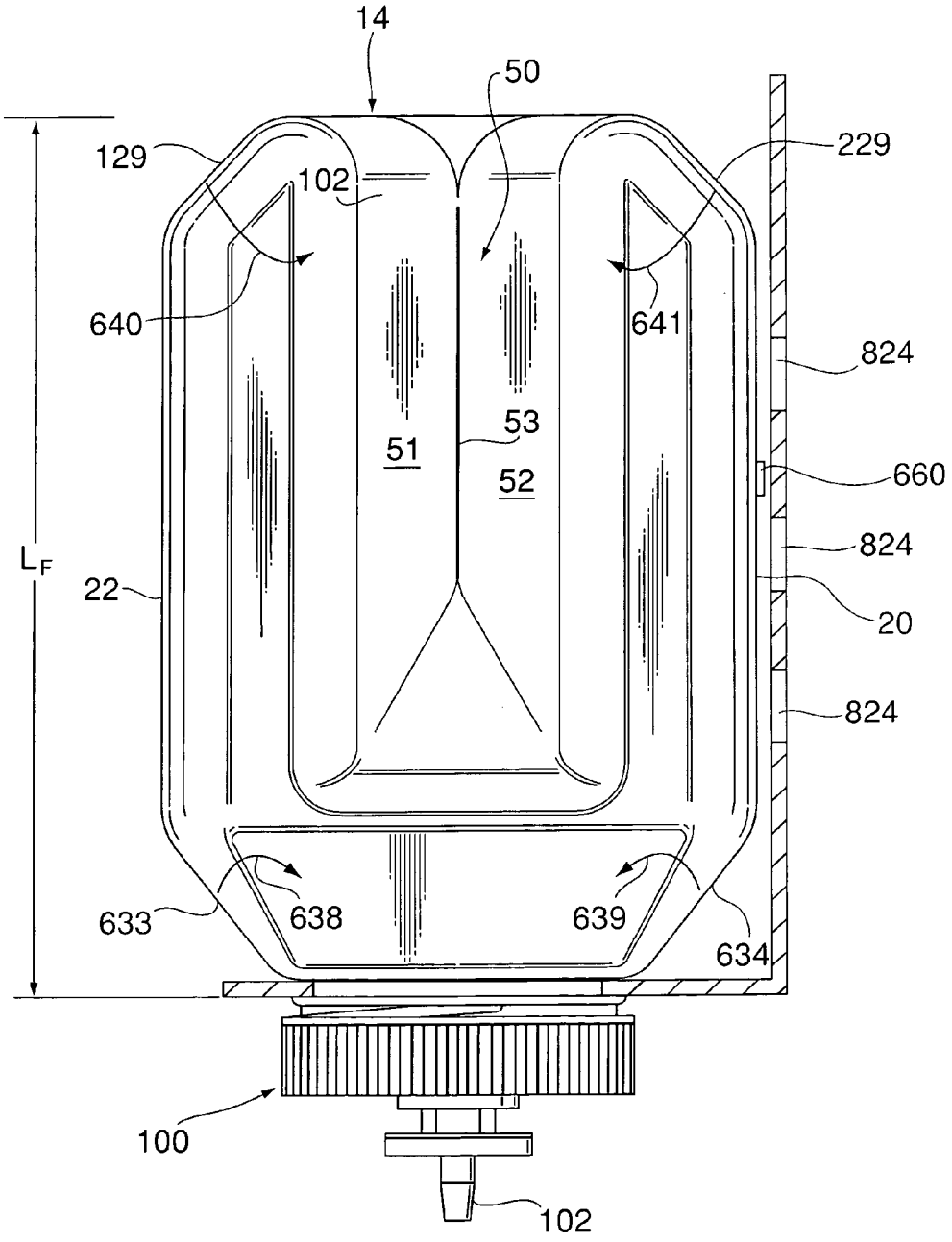
FIG. 29 is a side view of the bottle shown in FIG. 28 with a pump mechanism and a cover secured thereto and the bottle in a full condition.
Figure 30:
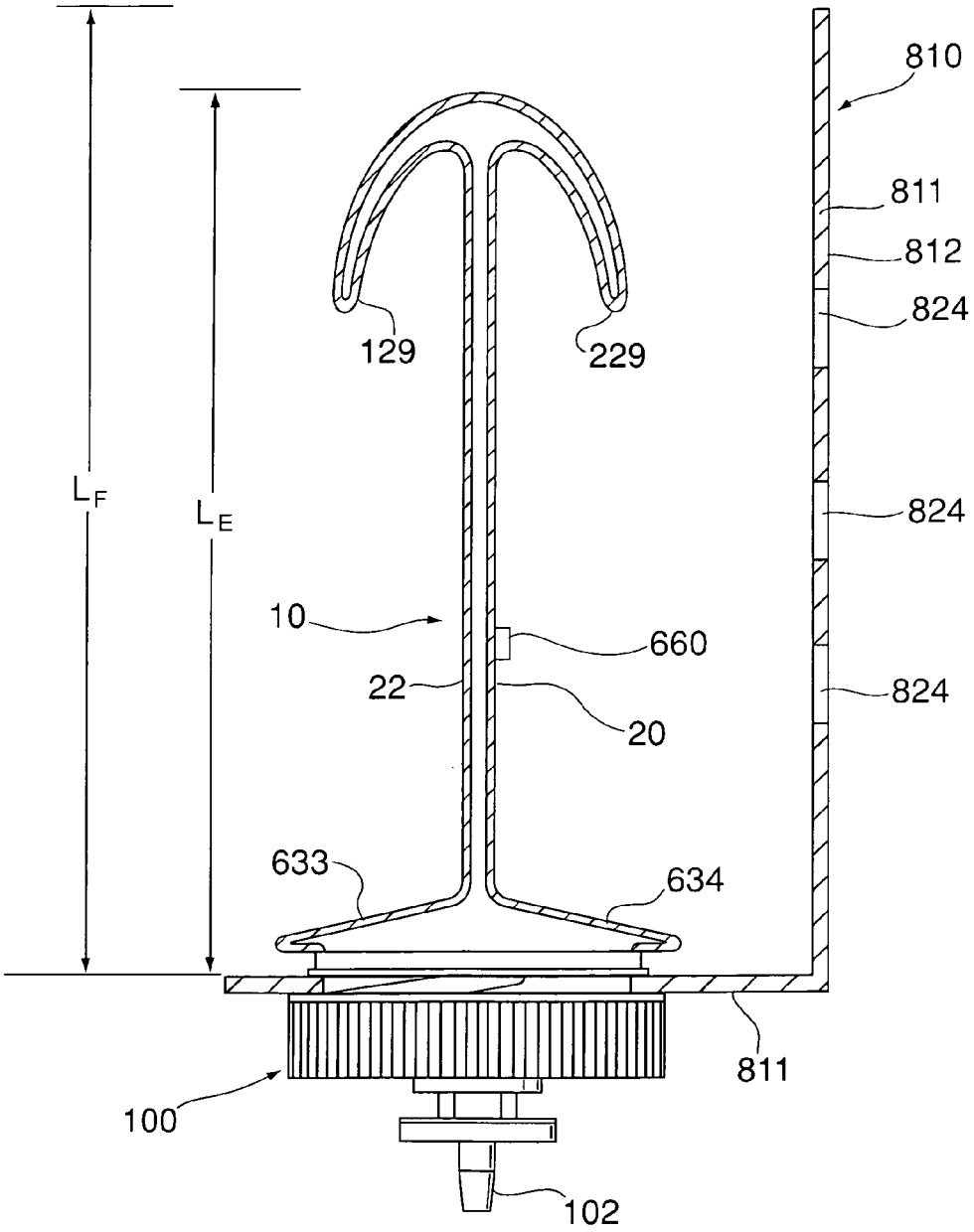
FIG. 30 is a side view of the bottle shown in FIG. 28 the same as in FIG. 29 but with the bottle in a collapsed emptied condition.

Reference is made to a second embodiment of a bottle 10 shown in FIGS. 28, 29 and 30 as disclosed in the applicant's U.S. patent application Publication US 2006/0032865 published Feb. 16, 2006, the disclosure of which is incorporated herein by reference. The bottle 10 has many similarities to the bottle in the first embodiment. The bottle includes a front wall 16, a rear wall 18 and two side walls 20 and 22. The bottle is closed but for an opening from the outlet end 12. The outlet end has a top wall 26 with a generally rectangular perimeter as seen in end view. The top wall 26 includes an annular central portion about an axially extending neck. The neck 30 is open to the opening. The top wall 26 includes peripheral edge portions about the central portion which central edge portions merge with the front wall 16, rear wall 18 and two side walls 20 and 22. The front wall 16 carries a front valley 50 defined by left valley wall 51 and right valley wall 52 which extend centrally into the front wall 16 to a front valley apex 53 extending longitudinally of the bottle. The rear wall 18 is a mirror image of the front wall 16. The front valley 50 extends continuously through to the base end 14. On collapse of the bottle, the opposed valley walls 51 and 52 of the front valley 50 become drawn together and, similarly, the opposed valley walls of the rear valley are drawn together. As well, on collapse of the bottle, the peripheral edge portions 633 and 634 are drawn inwardly as indicated by the arrows 638 and 639 in FIG. 29 at the same time that bottom shoulders 621 and 622 proximate the base end 14 are drawn inwardly as indicated by the arrows 640 and 641 in FIG. 29. FIG. 30 shows a side view of the bottle of FIG. 28 similar to that shown in FIG. 29, however, after the bottle has been substantially collapsed and all the fluid drawn therefrom. As can be seen, the side walls 20 and 22 have been drawn together, the peripheral edge portion 633 and 634 have been drawn to extend inwardly and the base edge portions 621 and 622 have also been drawn inwardly. In the full condition as shown in FIG. 29, the bottle is indicated as having a length $L_f$. FIG. 30 shows approximately the same length of full bottle $L_f$ and also shows the length of an empty bottle indicated as $L_e$. As seen in FIG. 30, in the bottle moving from the full condition to the empty condition, the length of the bottle is reduced.

The bottle illustrated in FIGS. 28 to 30 is another example of a bottle which on collapsing under a vacuum applied to withdraw fluid from the outlet end has portions of the side wall drawn together to fold the side wall about itself and draw the base end longitudinally towards the outlet end with a relative longitudinal position, compared to the outlet end, of the base end and portions of the front, rear and side walls being indicative of the extent to which the bottle is uncollapsed or collapsed. FIGS. 29 and 30 also illustrate a rigid plastic cover 810 secured to the neck of the bottle via a panel 811 and extending upwardly as a front sighting panel 812 which is rigid. The front sighting panel 812 is schematically illustrated to have a plurality of sight openings 824 therein as, for example, to permit a person to view an indicia such as a raised boss 660 on the side wall 20 with the relative height of the raised boss 660 compared to the sight openings providing an indication as the extent to which the bottle 10 may be full or empty.

The bottle 10 shown in FIGS. 29 and 30 are shown in an inverted condition and the cover 810 in accordance with the present invention is readily adapted for use in an inverted condition. With the cover as shown coupled to the neck of the bottle 10, it is to be appreciated that the cover 10 might comprise a portion of a substantial housing to contain a collapsible container as, for example, as illustrated in U.S. Pat. No. 7,232,045 to Ophardt, issued Jun. 19, 2007.

The two bottles as illustrated in FIGS. 13 and 28 are but illustrative of bottles in which, on collapsing, by a vacuum being created within the bottle, the base end 14 and portions of the front, rear and side walls are drawn longitudinally towards the outlet end of the bottle and are, to some extent, indicative of the extent to which the bottle is collapsed or uncollapsed. Various other forms of such bottles may occur to persons skilled in the art. They will include, for example, bottles having a configuration as illustrated, for example, in the applicant's design patent Des. 350,070, issued Aug. 30, 1994 as well as other known bottles. Other known collapsible bottles and containers whose lengths vary as they move from a full condition to an empty condition include the container illustrated in U.S. Pat. No. 6,158,620 to Polan issued Dec. 12, 2000, whose length decreases as the bottle is emptied and the bottle shown in U.S. Pat. No. 3,727,803 to Cobb issued Apr. 17, 1973, whose length increases.

The preferred embodiment shows the bottles are all supported by their outlet and as being arranged to dispense upwardly from the top or downwardly from a bottom, however, there is no limit to the orientation in which the longitudinal of the bottles may be directed since they collapse under vacuum and the relative movement of the base end towards the outlet end will occur whether the bottle is disposed with its outlet upwardly or its outlet downwardly or, for example, with the longitudinal of the bottle disposed horizontally or some angled orientation.

The pump assembly 100 as in each of FIGS. 1, 12, 19 and 29 may comprise a piston pump mechanism to draw fluid from the bottle 10 permitting only exit of material from the bottle 10 and preventing air to enter the bottle 10. In operation of the pump assembly 100, a vacuum is created in the bottle 10. The piston pump mechanism may preferably be of the type disclosed in one or more of U.S. Pat. No. 5,165,577 to Ophardt issued Nov. 24, 1992 and U.S. Pat. No. 5,975,360 to Ophardt issued Nov. 2, 1999, albeit without permitting air passage back into the bottle. Such preformed pumps do not have or require dip tubes to extend into fluid in the bottle 10. The bottle 10 preferably is completely filled with liquid to be dispensed and all air or other gases evacuated prior to use in dispensing as, for example, by a method disclosed in U.S. Pat. No. 5,489,044 to Ophardt issued Feb. 6, 1996. In such liquid filled bottles, the pump will dispense fluid and collapse the bottle no matter what orientation the bottle is in.

The invention has been disclosed showing various preferred embodiments for the cover 810. The interaction of the cover 812 and the bottle 10 is such that the cover 812 does not prevent the bottle 10 from moving from the full collapsed condition to a collapsed position with the bottle 10 in moving between these positions having its dimensions, preferably its length, change relative to its fixed neck. The cover 810 is to provide preferably a visual reference for such change in dimension of the bottle. The cover 810 must be sized and located to not prevent the change in dimension of the bottle and to permit the bottle sufficient room or space for the change to occur. The cover may, however, act as a guideway as, for example, in the case of FIG. 19, to guide and constrain the location of the bottle 10 which can assist in having the change in dimension in the bottle be representative of the extent to which the bottle is full or empty. For example, in the case of a sleeve-like cover 10 in FIG. 19, sliding engagement of lower portions of the bottle 10 can assist in a more consistent movement of the base end of the bottle 10 upwardly.

While the invention has been described with reference to preferred embodiments, many modifications and variations will now occur to persons skilled in the art. For a definition of the invention, reference is made to the following claims.

We claim:

1. A thin walled collapsible container, the container comprising an outlet end, a closed base end, a front wall, a rear wall and two side walls, the container closed but for an opening from the outlet end, the outlet end having a top wall with a generally rectangular perimeter as seen in end view, the top wall including an annular central portion about an axially extending neck open to the opening and peripheral edge portions about the central portion merging with the front, rear and two side walls, the front, rear and two side walls extending longitudinally of the container from the outlet end to the base end about a longitudinal of the container parallel an axis coaxially through the neck, a flat central plane is disposed intermediate the side walls, the longitudinal lies in the flat central plane, the container symmetrical about the flat central plane, the base end having a bottom wall with a generally rectangular perimeter as seen in end view, the bottom wall including a central portion and peripheral rounded edge portions about the central portion merging the central portion into the front, rear and two side walls, the base end having support portions of the peripheral rounded edge portions of the base end disposed in a flat plane normal to the longitudinal of the container and serving to support the container on a horizontal support surface with the longitudinal of the container to extend vertically upwardly, the front wall and rear wall each carrying a respective front and rear valley having left and right valley side walls extending centrally into each front and rear valley toward a respective other of the rear and front wall to a respective front and rear valley apex each extending longitudinally of the container in the flat central plane from an outlet end of the respective front and rear valley apex to a base end of the respective front and rear valley apex, each of the front and rear valley ending longitudinally in a respective front and rear valley outlet end valley end wall which bridges between the right and left valley side walls of its respective front and rear valley, the front and rear outlet end valley end wall being located between its respective front and rear valley and the outlet end, each of the front and rear valley ending longitudinally in a respective front and rear valley base end valley end wall which bridges between the right and left valley side walls of its respective front and rear valley, the front and rear base end valley end wall being located between its respective front and rear valley and the base end, each valley end wall presenting a generally frusto-conical surface symmetrical about the flat central plane and curving 180 degrees about its respective outlet end or base end of its front and rear valley apex, wherein on collapsing of the container under a vacuum applied to withdraw fluid from the opening the side walls are drawn together towards the flat central plane with the front and rear walls folding about the front valley apex and the rear valley apex, the base end having a three dimensional structure formed by its bottom wall, central portion and peripheral edge portions sufficiently strong to resist deflection and maintain its support portions in a flat plane on collapsing of the container.

2. In combination a collapsible container, a pump mechanism, and a cover for the container; the container comprising an outlet end, a closed base end, and a side wall connecting the outlet end and the closed base end, the container closed but for an opening from the outlet end, the outlet end having a top wall; the top wall including a central portion about an axially extending neck open to the opening and peripheral edge portions about the central portion merging with the side wall, the side wall extending longitudinally of the container from the outlet end to the base end about a longitudinal of the container, the base end having a bottom wall including a central portion and peripheral edge portions about the central portion merging the central portion into the side wall, the container being of a type which on collapsing of the container under a vacuum applied to withdraw fluid from the opening, portions of the side wall are drawn together to fold about the side wall upon itself and draw the base end longitudinally toward the outlet end with the relative longitudinal position compared to the outlet end of the base end and portions of the side wall being indicative of the extent to which the bottle is uncollapsed or collapsed, the pump mechanism coupled to the container and activatable to draw fluid out of the container via the outlet opening and creating a vacuum in the container, the cover connected to the outlet end of the container, the cover having a sighting wall panel fixed to extend longitudinally from the outlet end toward the base end longitudinally along the side wall of the container outwardly of the side wall of the container, a sight opening through the sighting wall panel through which a person may view portions of the container behind the sight opening, visual indicia provided on the base end and/or portions of the side wall which are drawn toward the outlet end on collapsing of the container, the visual indicia being visible through the sight opening and the relative longitudinal position of the visual indicia compared to the sight opening being indicative of the extent to which the bottle is uncollapsed or collapsed, the side wall comprising a front wall portion, a rear wall portion and two side wall portions, the container closed but for an opening from the outlet end, the top wall having a generally rectangular perimeter as seen in end view, the top wall including an annular central portion about an axially extending neck open to the opening, the longitudinal of the container parallel an axis coaxially through the neck, a flat central plane is disposed intermediate the side walls, the longitudinal lies in the flat central plane the container symmetrical about the flat central plane, the bottom wall having a generally rectangular perimeter as seen in end view, the base having support portions of the peripheral rounded edge portions of the base end disposed in a flat plane normal to the longitudinal of the container and serving to support the container on a horizontal support surface with the longitudinal of the container to extend vertically upwardly, the front wall portion and rear wall portion each carrying a respective front and rear valley having left and right valley side walls extending centrally into each front and rear wall portion toward a respective other of the rear and front wall portion to a respective front and rear valley apex each extending longitudinally of the container in the flat central plane from an outlet end of the respective front and rear valley apex to a base end of the respective front and rear valley apex, each of the front and rear valley ending longitudinally in a respective front and rear valley outlet end valley end wall which bridges between the right and left valley side walls of its respective front and rear valley, the front and rear outlet end valley end wall being located between its respective front and rear valley and the outlet end, each of the front and rear valley ending longitudinally in a respective front and rear valley base end valley end wall which bridges between the right and left valley side walls of its respective front and rear valley, the front and rear base end valley end wall being located between its respective front and rear valley and the base end, each valley end wall presenting a generally frusto-conical surface symmetrical about the flat central plane and curving 180 degrees about its respective outlet end or base end of its front and rear valley apex, wherein on collapsing of the container under a vacuum applied to withdraw fluid from the outlet end the side wall portions are drawn together towards the flat central plane with the front and rear wall portions folding about the front valley apex and the rear valley apex, the base end having a three dimensional structure formed by its bottom wall, central portion and peripheral edge portions sufficiently strong to resist deflection and maintain its support portions in a flat plane substantially normal to the central flat plane on collapsing of the container.

3. A combination as claimed in claim 2 wherein:

each of the front wall portion and rear wall portion have a substantially planar portion surrounding their respective valley, each left and right valley side wall being disposed in a flat plane with a perimeter of each left and right valley side wall merging along a straight line with the planar portion extending parallel to the longitudinal, a perimeter of each valley end wall merging along a curved line with the planar portion and joining an end of the straight line of the right valley wall perimeter with an end of the straight line of the left valley wall perimeter, each perimeter of each valley end wall curving 180 degrees about its outlet end and base end of its front and rear valley apex.

4. A combination as claimed in claim 3 wherein the outlet end includes a three dimensional structure formed by its top wall, central portion, neck and peripheral edge portions sufficiently strong to resist deflection and maintain its peripheral edge portions in the same positions relative the neck on collapsing of the container.

5. A thin walled collapsible the container comprising an outlet end, a closed base end, a front wall, a rear wall and two side walls, the container closed but for an opening from the outlet end, the outlet end having a top wall with a generally rectangular perimeter as seen in end view, the top wall including an annular central portion about an axially extending neck open to the opening and peripheral edge portions about the central portion merging with the front, rear and two side walls, the front, rear and two side walls extending longitudinally of the container from the outlet end to the base end about a longitudinal of the container parallel an axis coaxially through the neck, a flat central plane is disposed intermediate the side walls, the longitudinal lies in the flat central plane, the container symmetrical about the flat central plane, the base end having a bottom wall with a generally rectangular perimeter as seen in end view, the bottom wall including a central portion and peripheral rounded edge portions about the central portion merging the central portion into the front, rear and two side walls, the base end having support portions of the peripheral rounded edge portions of the base end disposed in a flat plane normal to the longitudinal of the container and serving to support the container on a horizontal support surface with the longitudinal of the container to extend, vertically upwardly, the front wall and rear wall each carrying a respective front and rear valley having left and right valley side walls extending centrally into each front and rear valley toward a respective other of the rear and, front wall to a respective front and rear valley apex each extending longitudinally of the container in the flat central plane from an outlet end of the respective front and rear valley apex to a base end of the respective front and rear valley apex, each of the front and rear valley ending longitudinally in a respective front and rear valley outlet end, valley end wall which bridges between the right and, left valley side walls of its respective front and rear valley, the front and rear outlet end valley end wall being located between its respective front and rear valley and the outlet end, each of the front and rear valley ending longitudinally in a respective front and rear valley base end valley end wall which bridges between the right and left valley side walls of its respective front and rear valley, the front and rear base end valley end wall being located between its respective front and rear valley and the base end, each valley end wall presenting a generally frusto-conical surface symmetrical about the flat central plane and curving 180 degrees about its respective outlet end or base end of its front and rear valley apex, wherein on collapsing of the container under a vacuum applied to withdraw fluid from the opening the side walls are drawn together towards the flat central plane with the front and rear walls folding about the front valley apex and the rear valley apex, the base end having a three dimensional structure formed by its bottom wall, central, portion and peripheral edge portions sufficiently strong to resist deflection and maintain its support portions in a flat plane on collapsing of the container, each of the front wall and rear wall have a substantially planar portion surrounding their respective valley, each left and right valley side wall being disposed in a flat plane with a perimeter of each left and right valley side wall merging along a straight line with the planar portion extending parallel to the longitudinal, a perimeter of each valley end wall merging along a curved line with the planar portion and joining an end of the straight line of the right valley wall perimeter with an end of the straight line of the left valley wall perimeter, each perimeter of each valley end wall curving 180 degrees about its outlet end and base end of its front and rear valley apex.

6. A container as claimed in claim 5 wherein the outlet end having a three dimensional structure formed by its top wall, central portion, neck and peripheral edge portions sufficiently strong to resist deflection and maintain its peripheral edge portions in the same positions relative the neck on collapsing of the container.

7. A container as claimed in claim 6 wherein the front and rear valley apex are spaced from each other and providing a channelway therebetween along their length from the base end toward the outlet end in all collapsed and uncollapsed conditions of the container.

8. A container as claimed in claim 6 wherein on collapsing of the container under a vacuum applied to withdraw fluid from the opening, the side walls are drawn together about the front valley apex and the rear valley apex with the channelway provided at least as a front continuous channel substantially from the base end adjacent the front valley apex and a rear continuous channel substantially from the base end adjacent the rear valley apex.

9. A container as claimed in claim 8 wherein:

a first compartment is defined on a first side of the channelway bounded by an interior of a first of the side walls and the interiors of the front valley side wall and the rear valley side wall opposed thereto, and a second compartment is defined on a second side of the channelway bounded by an interior of a second of the side walls and the interiors of the front valley side wall and the rear valley side wall opposed thereto.

* * * * *